US008650837B2

(12) United States Patent
Watanabe et al.

(10) Patent No.: US 8,650,837 B2
(45) Date of Patent: Feb. 18, 2014

(54) APPARATUS FOR AND METHOD OF PACKAGING PRODUCT ROLLS

(75) Inventors: Fumio Watanabe, Kanagawa-ken (JP); Tsutomu Tada, Kanagawa-ken (JP); Nobuyasu Akiyoshi, Kanagawa-ken (JP); Yasushi Kikuchi, Kanagawa-ken (JP); Toshiaki Kenmotsu, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 526 days.

(21) Appl. No.: 13/041,865

(22) Filed: Mar. 7, 2011

(65) Prior Publication Data

US 2011/0239588 A1 Oct. 6, 2011

(30) Foreign Application Priority Data

Mar. 31, 2010 (JP) ..... 2010-082550

(51) Int. Cl.

*B65B 11/04* (2006.01)
*B65B 25/14* (2006.01)
*B65B 41/04* (2006.01)
*B65B 51/06* (2006.01)

(52) U.S. Cl.

USPC ..... 53/397; 53/416; 53/465; 53/51; 53/64; 53/66; 53/135.3; 53/138.1; 53/587; 53/211; 53/389.3

(58) Field of Classification Search

CPC .... B65B 41/04; B65B 25/148; B65B 25/146; B65B 25/14; B65B 51/06; B65B 11/04

USPC ..... 53/397, 416, 419, 461, 465, 51, 64, 66, 53/74, 135.3, 137.2, 138.1, 587, 203, 210, 53/211, 214, 389.3, 389.4

IPC ..... B65B 11/04,51/06, 25/14, 41/04

See application file for complete search history.

(56) References Cited

U.S. PATENT DOCUMENTS

| | | | | | |
|---|---|---|---|---|---|
| 1,764,081 | A | * | 6/1930 | Jones et al. | 53/51 |
| 2,261,344 | A | * | 11/1941 | Delegard | 53/465 |
| 2,644,282 | A | * | 7/1953 | Irvine | 53/211 |
| 3,099,117 | A | * | 7/1963 | Christiansen | 53/587 |

(Continued)

FOREIGN PATENT DOCUMENTS

| | | | | | |
|---|---|---|---|---|---|
| JP | 01167016 | A | * | 6/1989 | B65B 25/14 |
| JP | 01226517 | A | * | 9/1989 | B65B 25/14 |

(Continued)

*Primary Examiner* — Stephen F Gerrity

(74) *Attorney, Agent, or Firm* — Birch, Stewart, Kolasch & Birch, LLP

(57) ABSTRACT

A product roll packaging apparatus includes a transfer unit for lifting and transferring a product roll from a conveyor, a wrapping unit for wrapping a protective sheet around the roll and attaching an end thereof with an adhesive tape, a protective sheet supply unit for cutting off the sheet from a sheet roll and supplying it along a protective sheet path line to the wrapping unit, and a tape supply unit for supplying the tape to the end of the cut sheet. The transfer unit includes a position correcting mechanism for establishing a reference line depending on the roll size, and bringing a reference end face of the roll into alignment with a vertical plane including the reference line. The protective sheet supply unit includes an edge position control mechanism for bringing a reference edge of the sheet into alignment with the reference line corresponding to the roll size.

15 Claims, 16 Drawing Sheets

(56) References Cited

U.S. PATENT DOCUMENTS

| | | | | | |
|---|---|---|---|---|---|
| 3,342,014 | A | * | 9/1967 | Prager | 53/214 |
| 3,429,097 | A | * | 2/1969 | Jasper et al. | 53/66 |
| 3,494,095 | A | * | 2/1970 | Valvano | 53/465 |
| 4,485,612 | A | * | 12/1984 | Piesen et al. | 53/211 |
| 5,299,411 | A | * | 4/1994 | Yamamoto et al. | 53/465 |
| 5,533,321 | A | * | 7/1996 | Hooper et al. | 53/211 |
| 7,661,243 | B2 | * | 2/2010 | Lindberg | 53/210 |

FOREIGN PATENT DOCUMENTS

| | | | | | |
|---|---|---|---|---|---|
| JP | 06135413 | A | * | 5/1994 | B65B 25/14 |
| JP | 2004131170 | A | * | 4/2004 | B65B 11/04 |
| JP | 2008-87791 | A | | 4/2008 | |

* cited by examiner

52

APPARATUS FOR AND METHOD OF PACKAGING PRODUCT ROLLS

CROSS-REFERENCE TO RELATED APPLICATION

This application is based upon and claims the benefit of priority from Japanese Patent Application No. 2010-082550 filed on Mar. 31, 2010, of which the contents are incorporated herein by reference.

BACKGROUND OF THE INVENTION

1. Field of the Invention:

The present invention relates to an apparatus for and a method of packaging product rolls by wrapping protective sheets around the product rolls.

2. Description of the Related Art:

Heretofore, there has been known a roll packaging apparatus for automatically packaging a roll of paper (product roll) with a packaging sheet (protective sheet) (see Japanese Laid-Open Patent Publication No. 2008-087791).

The roll packaging apparatus disclosed in Japanese Laid-Open Patent Publication No. 2008-087791 operates in the following manner. A roll of paper is rotated about its axis to unreel a leading end portion of continuous paper. When the leading end portion of the continuous paper is extended from the roll, the roll of paper is stopped against rotation. Then, a leading end of a packaging sheet having a prescribed length is inserted into the gap between the leading end portion and the roll itself, and adhesive tape is applied to a trailing end of the packaging sheet.

However, the roll packaging apparatus disclosed in Japanese Laid-Open Patent Publication No. 2008-087791 is problematic in that the roll of paper and the packaging sheet cannot be positioned widthwise, and the roll of paper cannot be packaged accurately in a widthwise manner by the packaging sheet. When the leading end of the packaging sheet is inserted into the gap, the packaging sheet is guided by a feeder guide. When the packaging sheet is guided by the feeder guide, the packaging sheet produces a paper dust, which tends to contaminate the roll of paper.

Problems of the roll packaging apparatus disclosed in Japanese Laid-Open Patent Publication No. 2008-087791 will be described more specifically in detail below with reference to FIG. 1 of the publication. Reference characters thereof are given in parentheses.

There are at least two problems that occur when attempts are made to wrap a protective sheet (packaging sheet) accurately in a widthwise manner according to Japanese Laid-Open Patent Publication No. 2008-087791.

The first problem is that, when a packaging sheet (31) reaches a deepest point in a region (B) of a roll (11) of paper, the packaging sheet (31) is positioned widthwise only by a feeder guide (32). Since the packaging sheet (31) is craft paper, for example, if the packaging sheet (31) is curled in a widthwise manner, the substantial width thereof is reduced, thereby increasing the clearance between the packaging sheet (31) and the feeder guide (32). As a result, the leading end of the packaging sheet (31) may be inserted at a position, which is displaced about 1 mm off from the desired position.

The second problem is that, after the packaging sheet (31) has been inserted and cut off by a cutter (34), and then an actuator (23) resumes rotation of the roll (11) of paper to thereby cause the trailing end of the packaging sheet (31), to which an adhesive tape (41) is applied, to move past the feeder roller (33), the accuracy with which the trailing end of the packaging sheet (31) is wound on the roll (11) of paper depends on the degree of cylindricality of the roll (11) of paper, as well as the angle at which the leading end of the packaging sheet (31) is inserted. Since the roll (11) of paper is in the form of a coil of continuous paper (12) wound in layers, the roll (11) of paper may possibly be of a conical or bobbin-like shape. Therefore, even if the leading end of the packaging sheet (31) is inserted accurately, the wound shape of the packaging sheet (31) tends to suffer from accumulated errors when the trailing end thereof ends up being wound on the roll (11) of paper. Even if the angle at which the leading end of the packaging sheet (31) is inserted deviates only 0.1° from the correct angle, it is evident that the trailing end of the packaging sheet (31) suffers from a large error.

If attempts are made to reduce the clearance between the packaging sheet (31) and the feeder guide (32) for the purpose of increasing the accuracy at which the packaging sheet (31) is wound around the roll (11) of paper, then the packaging sheet (31) produces a large quantity of paper dust due to abrasive friction with the feeder guide (32), and such paper dust is liable to stick undesirably to the roll (11) of paper that is to be protected.

SUMMARY OF THE INVENTION

An object of the present invention is to provide an apparatus for and a method of packaging product rolls with protective sheets, which achieves the following advantages.

(1) A protective sheet (packaging sheet) is wrapped accurately in a widthwise manner around a product roll (roll of paper) to automatically package the roll of paper without allowing the paper surface of the roll of paper to be exposed, and also without having the protective sheet project significantly from end faces of the product roll, even if the protective sheet is of substantially the same width as the product roll, so that the surface quality of the product roll is maintained and the protective sheet is free from edge bends.

(2) Any parts tending to be held in abrasive friction with the protective sheet are minimized in order to reduce the risk of contaminating the product roll with paper dust, which otherwise would be produced by frictional engagement between such parts and edges of the protective sheet.

(3) A highly efficient automatic packaging apparatus is required to package mass-produced product rolls. If such a packaging apparatus has a single packaging unit, then multiple packaging apparatus are needed in order to achieve increased throughput. However, such packaging apparatus are costly and take up a large amount of factory space. In contrast, the packaging apparatus according to the present invention has a plurality of packaging units and achieves a high throughput, although the packaging apparatus takes up a relatively small amount of factory space.

According to a first aspect of the present invention, there is provided a product roll packaging apparatus for packaging a product roll, which comprises a core and a roll of recording paper wound around the core, with a protective sheet wrapped around the product roll, and having an end attached onto the protective sheet with an adhesive tape, comprising a buffer conveyor assembly for keeping a product roll waiting to be wrapped, a transfer unit for lifting and transferring the product roll from the buffer conveyor assembly, a wrapping unit for wrapping a protective sheet around the product roll and attaching an end of the protective sheet with the adhesive tape, a protective sheet supply unit for cutting off the protective sheet from a sheet roll and supplying the protective sheet along a protective sheet path line to the wrapping unit, and a tape supply unit for supplying the adhesive tape to the end of the protective sheet that has been cut by the protective sheet supply unit, wherein the transfer unit includes a position correcting mechanism for establishing a reference line depending on a size of the product roll, and for bringing a reference end face of the product roll, which has been lifted by the transfer unit, into alignment with a vertical plane including the reference line, and the protective sheet supply unit includes an edge position control (EPC) mechanism for bringing a reference edge of the protective sheet into alignment with the reference line established by the position correcting mechanism.

In the first aspect of the present invention, the product roll packaging apparatus further comprises a pair of first chucks operable in at least a first mode for mechanically gripping opposite sides of a leading end of the protective sheet and feeding the protective sheet, and a second mode for mechanically gripping opposite sides of a portion of the protective sheet other than the leading end and feeding the protective sheet, and a pair of second chucks for mechanically gripping the leading end of the protective sheet in response to the first mode of operation of the first chucks, the second chucks being retractable from the protective sheet path line in response to the second mode of operation of the first chucks.

In the first aspect of the present invention, the product roll packaging apparatus further comprises a pair of first chucks operable in at least a first mode for mechanically gripping opposite sides of a leading end of the protective sheet and feeding the protective sheet, a second mode for mechanically gripping opposite sides of a portion of the protective sheet other than the leading end and feeding the protective sheet, and a third mode for mechanically gripping opposite sides of a trailing end of the protective sheet other than the leading end and feeding the protective sheet, and a pair of second chucks for mechanically gripping the leading end of the protective sheet in response to the first mode of operation of the first chucks, the second chucks being retractable from the protective sheet path line in response to the second mode of operation of the first chucks.

In the first aspect of the present invention, the first chucks switch gripping positions on the protective sheet between the first mode and the second mode before supplying the protective sheet to the wrapping unit.

In the first aspect of the present invention, a total stroke by which the first chucks supply the protective sheet gripped thereby to the wrapping unit in the first mode and the second mode or in the first through third modes is at least 6.3 times a diameter of the product roll.

In the first aspect of the present invention, the product roll packaging apparatus further comprises a protective sheet supply roller for unreeling the protective sheet a predetermined length from the sheet roll, wherein the first chucks are normally biased along the protective sheet path line toward the wrapping unit, and the first chucks are movable over a stroke, which is longer than the stroke over which the protective sheet supply roller unreels the protective sheet from the sheet roll.

In the first aspect of the present invention, the wrapping unit comprises a drive mechanism for rotating and stopping the product roll, and a pair of wrapping arms for gripping opposite sides of the product roll while keeping the product roll rotatable, wherein the drive mechanism includes a pair of drive rollers for contacting a lower portion of the product roll and rotating the product roll, and the drive mechanism stops the product roll against rotation when at least an extended portion of the product roll is directed toward the protective sheet path line.

In the first aspect of the present invention, the wrapping unit comprises a drive mechanism for rotating and stopping the product roll, and a pair of wrapping arms for gripping opposite sides of the product roll while keeping the product roll rotatable, wherein the drive mechanism includes a pair of mechanical chucks comprising a reference-side mechanical chuck and an anti-reference-side mechanical chuck, the reference-side mechanical chuck having an end face lying in the vertical plane including the reference line, the anti-reference-side mechanical chuck being movable to accommodate different lengths of the cores of product rolls, and wherein the drive mechanism stops the product roll against rotation when at least an extended portion of the product roll is directed toward the protective sheet path line.

In the first aspect of the present invention, when the product roll is changed in size, at least the reference line established by the position correcting mechanism and the reference edge of the protective sheet are changed in position by intervals of ½ of a difference between the size of a product roll wrapped in a previous cycle and the size of a product roll to be wrapped in a present cycle.

In the first aspect of the present invention, the product roll and the protective sheet are substantially equal to each other in width.

According to a second aspect of the present invention, there is provided a product roll packaging apparatus for packaging a product roll, which comprises a core and a roll of recording paper wound around the core, with a protective sheet wrapped around the product roll, and having an end attached onto the protective sheet with an adhesive tape, comprising a buffer conveyor assembly for keeping a plurality of product rolls waiting to be wrapped, a plurality of packaging units, arrayed along a direction in which the buffer conveyor assembly feeds the product rolls, for packaging the product rolls with respective protective sheets wrapped therearound, and a discharge conveyor, disposed in confronting relation to the buffer conveyor assembly with the packaging units interposed therebetween, for discharging wrapped product rolls along the direction in which the buffer conveyor assembly feeds the product rolls, wherein each of the packaging units comprises a transfer unit for lifting and transferring one of the product rolls from the buffer conveyor assembly, a wrapping unit for wrapping a protective sheet around the product roll and attaching an end of the protective sheet with the adhesive tape, a protective sheet supply unit for cutting off the protective sheet from a sheet roll and supplying the protective sheet along a protective sheet path line to the wrapping unit, and a tape supply unit for supplying the adhesive tape to the end of the protective sheet that has been cut by the protective sheet supply unit, wherein the transfer unit includes a position correcting mechanism for establishing a reference line depending on a size of the product roll, and for bringing a reference end face of the product roll, which has been lifted by the transfer unit, into alignment with a vertical plane including the reference line, and the protective sheet supply unit includes an edge position control (EPC) mechanism for bringing a reference edge of the protective sheet into alignment with the reference line established by the position correcting mechanism.

According to a third aspect of the present invention, there is provided a product roll packaging method of packaging a product roll, which comprises a core and a roll of recording paper wound around the core, with a protective sheet wrapped around the product roll, and having an end attached onto the protective sheet with an adhesive tape, comprising the steps of keeping a product roll waiting to be wrapped, lifting and transferring the product roll to a wrapping unit, wrapping a protective sheet around the product roll, and attaching an end of the protective sheet with the adhesive tape, cutting off the protective sheet from a sheet roll and supplying the protective sheet along a protective sheet path line to the wrapping unit, and supplying the adhesive tape to the end of the protective sheet, wherein the step of transferring the product roll to the wrapping unit further comprises the steps of establishing a reference line depending on a size of the product roll, and bringing a reference end face of the product roll, which has been lifted, into alignment with a vertical plane including the reference line, and the step of supplying the adhesive tape further comprises the step of bringing a reference edge of the protective sheet into alignment with the reference line.

The product roll packaging apparatus and the product roll packaging method according to the present invention offer the following advantages.

(1) The product roll packaging apparatus and the product roll packaging method are capable of wrapping a protective sheet (packaging sheet) around a product roll (rolled paper) highly accurately in a widthwise manner. Even if the protective sheet has substantially the same width as the product roll, the product roll is prevented from being exposed from the protective sheet, and the protective sheet is prevented from projecting significantly from end faces of the product roll.

(2) The surface quality of the product roll is maintained at a desired level. In particular, if the product roll comprises a roll of recording paper for use with ink jet printers or a roll of photosensitive paper that is required to be of high printing quality, then the product roll needs to be protected in its entirety, i.e., the surface thereof must be prevented from becoming exposed. The product roll can be wrapped with a neat appearance using the protective sheet, which is free of edge folds.

(3) The product roll is prevented from being contaminated by paper dust, which would otherwise be produced if the protective sheet had edges thereof subjected to abrasive friction with other objects and paper debris, which would tend to be produced if the protective sheet had edge folds therein.

(4) It is necessary to use a highly efficient automatic packaging apparatus for packaging mass-produced product rolls formed with protective sheets. Heretofore, a single roll packaging apparatus has included a single packaging unit, and hence, multiple packaging apparatus are required in order to achieve increased throughput. However, packaging apparatus are costly and take up a large amount of factory space. In contrast, the product roll packaging apparatus according to the present invention has a plurality of packaging units and achieves a high throughput, although the product roll packaging apparatus takes up a relatively small amount of factory space.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

An apparatus for and a method of packaging product rolls with protective sheets according to an embodiment of the present invention will be described in detail below with reference to FIGS. 1 through 16D.

Figure 1:
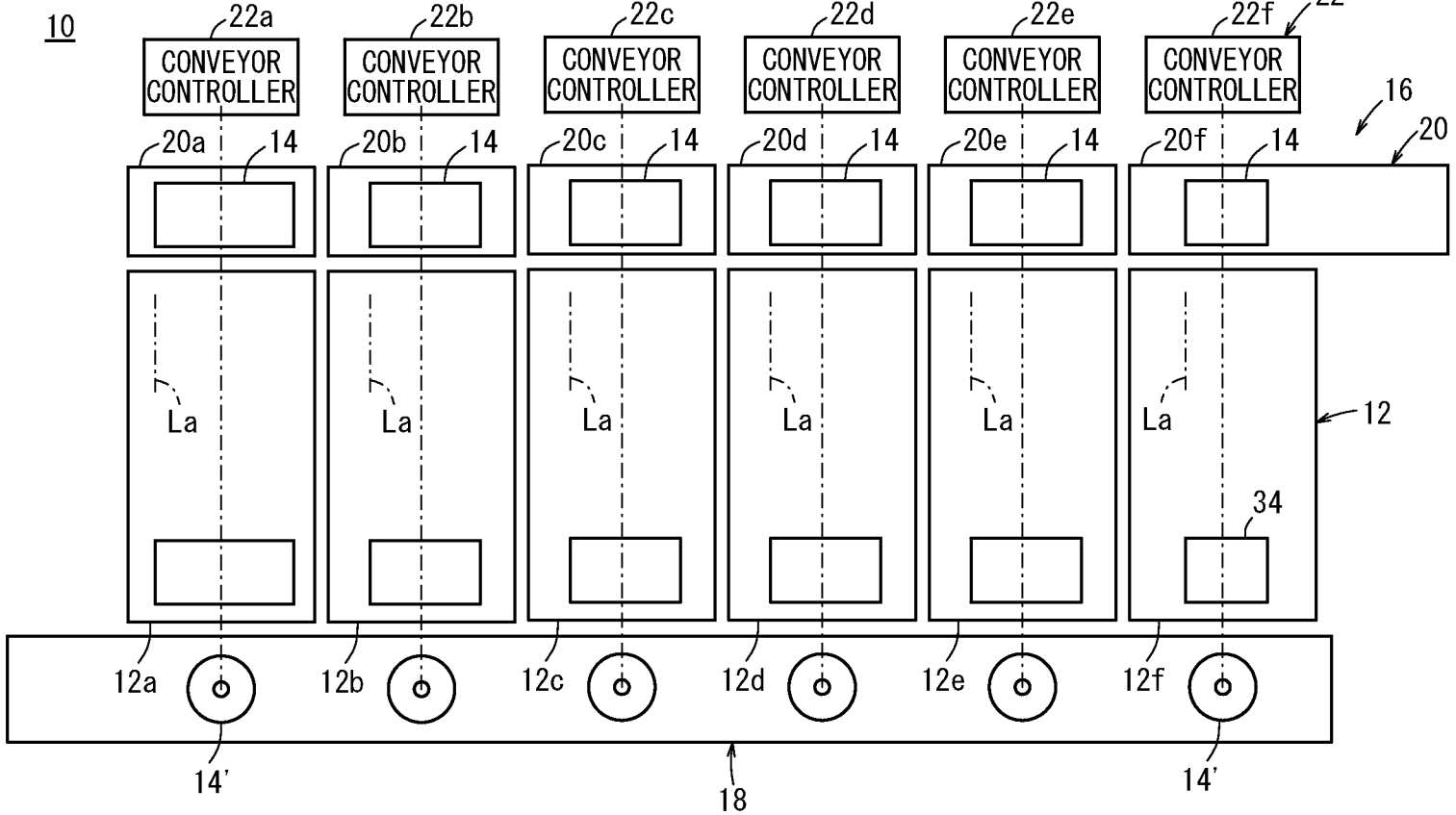
FIG. 1 is a schematic plan view of a product roll packaging apparatus according to an embodiment of the present invention.

As shown in FIG. 1, a product roll packaging apparatus 10 according to an embodiment of the present invention has a plurality of packaging units 12 (six as shown in FIG. 1).

More specifically, the product roll packaging apparatus 10 includes a buffer conveyor assembly 16 disposed in an upstream region for keeping product rolls 14 waiting to be wrapped, a single discharge conveyor 18 disposed in a downstream region in confronting relation to the buffer conveyor assembly 16, for discharging product rolls 14' wrapped with protective sheets, and six packaging units 12, i.e., first through six packaging units 12*a* through 12*f*, disposed in juxtaposition between the buffer conveyor assembly 16 and the discharge conveyor 18. The packaging units 12 are arrayed along a direction in which the buffer conveyor assembly 16 feeds the product rolls 14.

The buffer conveyor assembly 16 comprises six conveyors 20, i.e., first through six conveyors 20*a* through 20*f*, associated respectively with the packaging units 12, and six conveyor controllers 22, i.e., first through six conveyor controllers 22*a* through 22*f*, for controlling the conveyor speeds of the first through six conveyors 20*a* through 20*f*. The first through six conveyors 20*a* through 20*f* are arranged successively in a row, such that conveying directions thereof are held in alignment with each other. In FIG. 1, electrical connections between the first through six conveyors 20*a* through 20*f* and the first through six conveyor controllers 22*a* through 22*f* are omitted from illustration.

Each of the product rolls 14 comprises a core and a roll of paper wound around the core. Generally, product rolls 14 are available in different widths, i.e., different axial core lengths, of 10 inches, 8 inches, 6 inches, 5 inches, and 4 inches. The roll of paper may comprise a roll of recording paper for use with ink jet printers, for example. In FIG. 1, a product roll 14 having a width of 8 inches is transported to the first conveyor 20*a*, product rolls 14 having widths of 6 inches are transported to the second through fifth conveyors 20*b* through 20*e*, and a product roll 14 having a width of 4 inches is transported to the sixth conveyor 20*f*.

Figure 2:
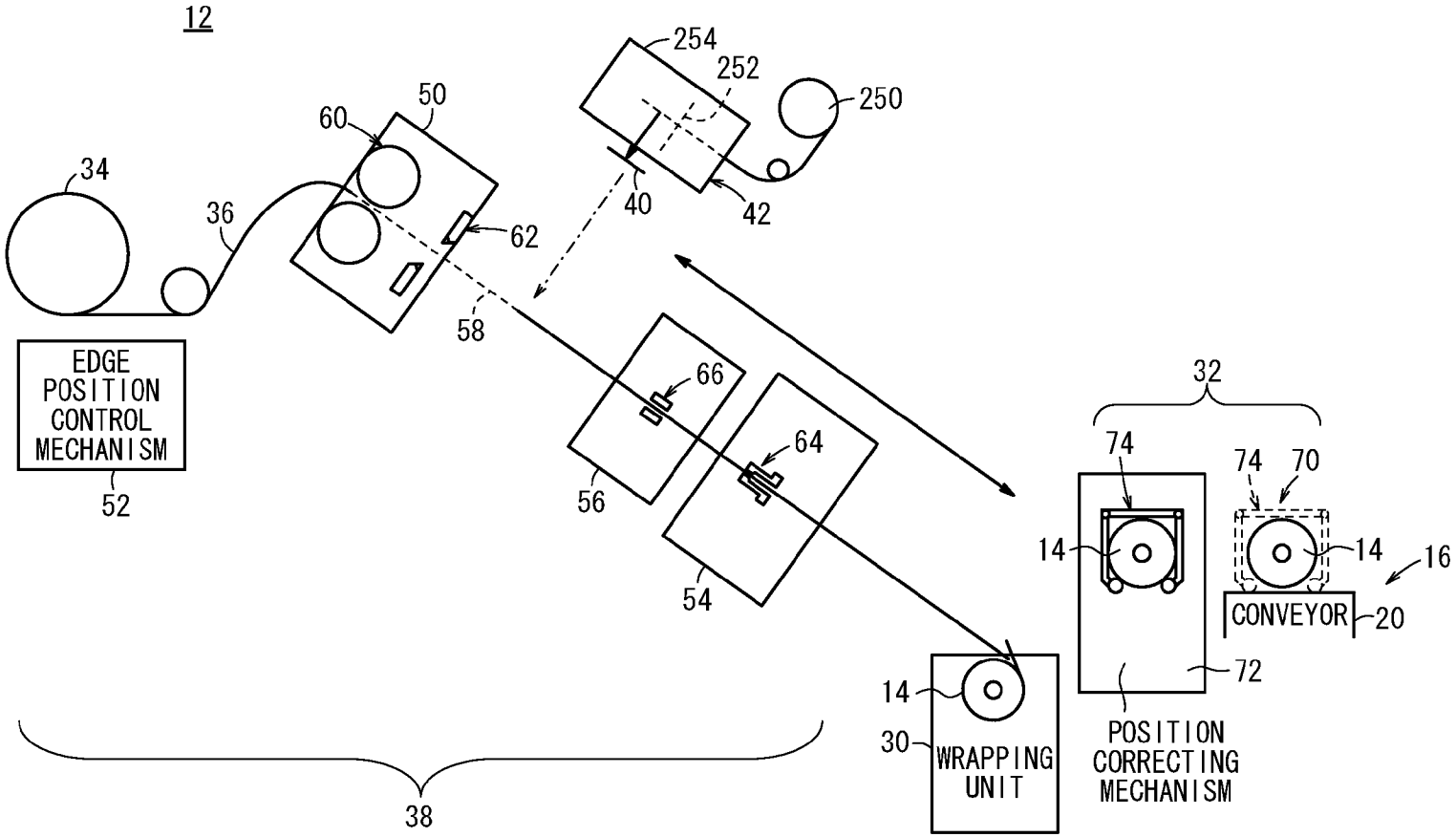
FIG. 2 is a schematic side elevational view of the product roll packaging apparatus according to the embodiment of the present invention.

As shown in FIG. 2, each of the packaging units 12 comprises a transfer unit 32 for lifting a product roll 14 on the buffer conveyor assembly 16, correcting the position of the product roll 14, and transferring the product roll 14 onto a wrapping unit 30, to be described later, a protective sheet supply unit 38 for cutting off a protective sheet 36 from a sheet roll 34 and supplying the protective sheet 36 to the wrapping unit 30, a tape supply unit 42 for supplying an adhesive tape 40 to the trailing end of the protective sheet 36 that was cut off by the protective sheet supply unit 38, and the wrapping unit 30 for wrapping the protective sheet 36 and attaching the trailing end of the protective sheet 36 with the adhesive tape 40.

The protective sheet supply unit 38 comprises a protective sheet supply mechanism 50, an edge position control (EPC) mechanism 52, a protective sheet feeding mechanism 54, and a protective sheet holding mechanism 56.

The protective sheet supply mechanism 50 comprises a pair of protective sheet supply rollers 60 for guiding the protective sheet 36, as the protective sheet 36 is unreeled from the sheet roll 34, to a protective sheet path line 58, and a pair of cutters 62 for cutting off the unreeled protective sheet 36 at a predetermined length. The EPC mechanism 52 controls the protective sheet 36 to bring a reference edge thereof into alignment with a reference line La (see FIG. 1). The protective sheet feeding mechanism 54 includes a pair of first chucks 64 for mechanically gripping opposite edges of the protective sheet 36, the first chucks 64 being movable forward or backward to a desired position at a desired speed parallel to the reference line La. The protective sheet holding mechanism 56 includes a pair of second chucks 66 for mechanically gripping the leading end of the protective sheet 36, the second chucks 66 being retractable from the protective sheet path line 58.

Specific structural details of the units will be described below with reference to FIGS. 2 through 12.

As shown in FIG. 2, the transfer unit 32 comprises a transfer mechanism 70 for lifting a product roll 14, carrying the product roll 14 to the wrapping unit 30, and placing the product roll 14 in the wrapping unit 30, and a position correcting mechanism 72 for correcting the position of a product roll 14 while the product roll 14 is carried by the transfer mechanism 70.

Figure 3:
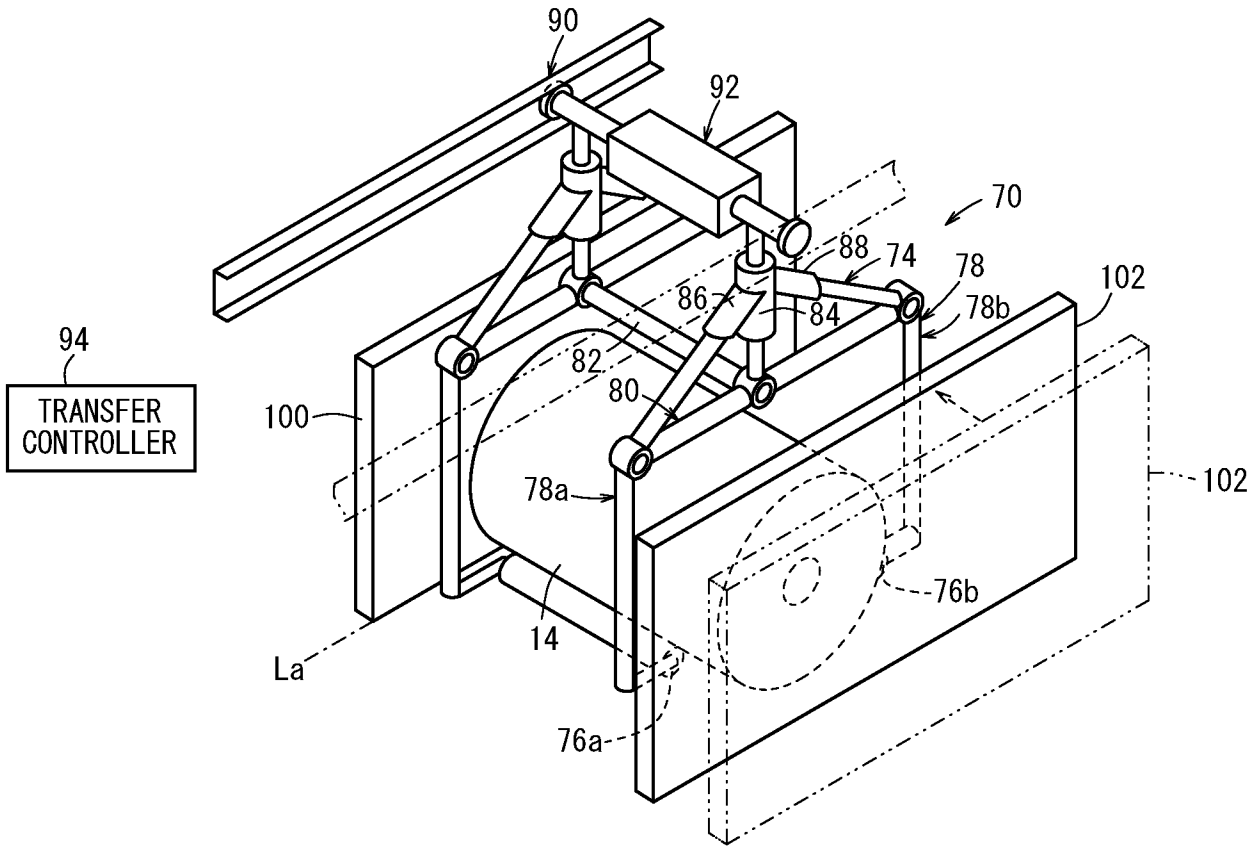
FIG. 3 is a perspective view, partially omitted from illustration, of a transfer unit of the product roll packaging apparatus.
Figure 4:
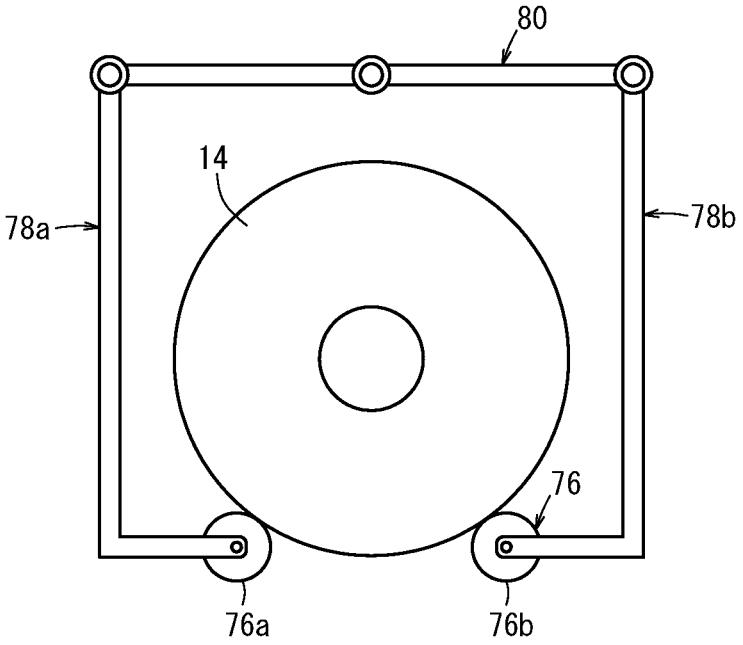
FIG. 4 is a side elevational view showing a product roll lifted by a transfer robot.

As shown in FIG. 3, the transfer mechanism 70 has a transfer robot 74 in the form of a frame. The transfer robot 74 comprises a pair of rollers 76, i.e., a pair of rollers 76*a*, 76*b*, (see FIG. 4), disposed in a lower portion thereof, two pairs of arms 78 for moving the rollers 76 toward and away from each other, i.e., a first pair of arms 78*a* for moving the roller 76*a* and a second pair of arms 78*b* for moving the roller 76*b*, a pair of beam members 80 by which the two pairs of arms 78 are rotatably supported, and a support member 82 supporting the beam members 80, which are spaced a given distance from each other. When the rollers 76*a*, 76*b* are placed below a product roll 14 and moved toward each other, as shown in FIG. 4, the rollers 76*a*, 76*b* are disposed in respective positions below the product roll 14 and are angularly spaced an angle of 30° from a vertical line (gravitational direction) passing through the center of the product roll 14. At this time, straight lines passing through the center of the product roll 14 and the centers of the rollers 76*a*, 76*b* form a central angle of 60° therebetween.

The transfer mechanism 70 also includes a pair of vertical moving mechanisms 84 comprising fluid-pressure cylinders or the like for vertically moving the respective beam members 80, a pair of first turning mechanisms 86 comprising fluid-pressure cylinders or the like for turning the first pair of arms 78*a*, a pair of second turning mechanisms 88 comprising fluid-pressure cylinders or the like for turning the second pair of arms 78*b*, a pair of guide rails 90 for guiding the transfer robot 74 so as to move therealong between the conveyor 20 and the wrapping unit 30, a feeding mechanism 92 comprising a motor, wheels, etc., for feeding the transfer robot 74 along the guide rails 90, and a transfer controller 94 for controlling the first turning mechanisms 86, the second turning mechanisms 88, and the feeding mechanism 92. In FIG. 3, electrical connections between the mechanisms 86, 88, 92 and the transfer controller 94 are omitted from illustration.

Figure 5:
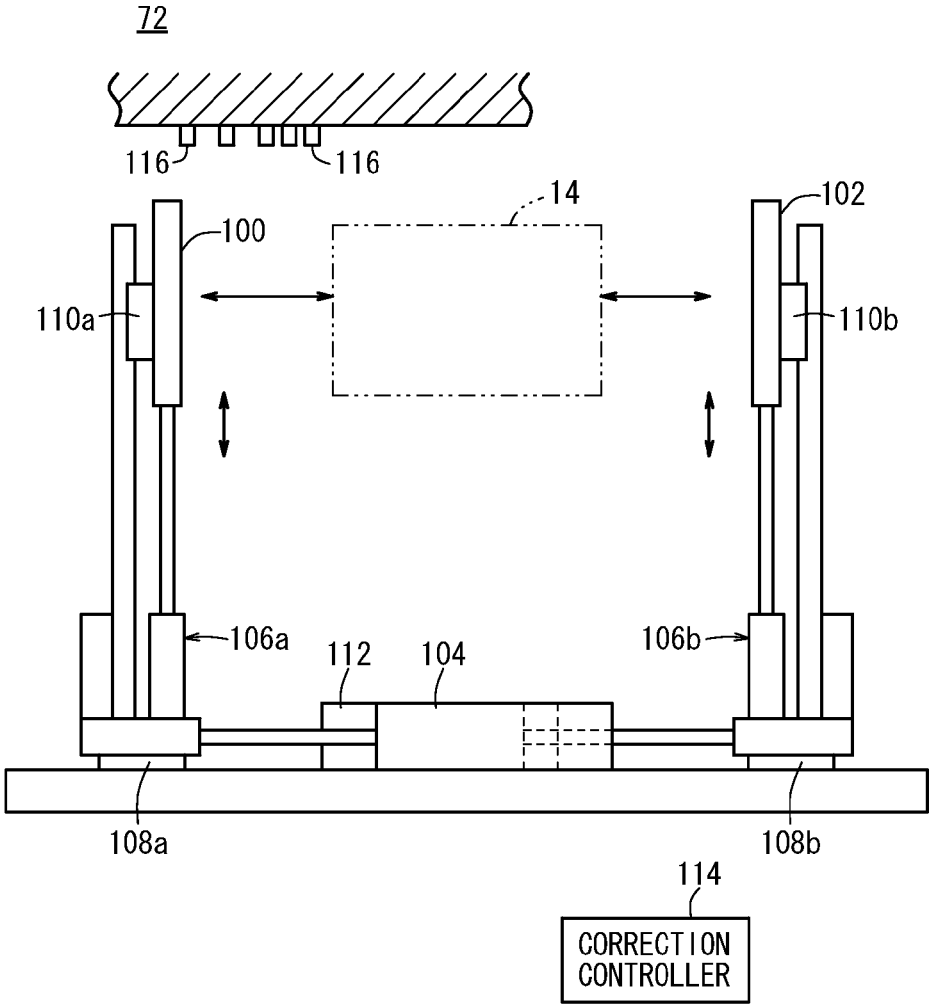
FIG. 5 is a front elevational view of a position correcting mechanism.

As shown in FIGS. 3 and 5, the position correcting mechanism 72 comprises a reference plate 100 vertically movable in alignment with the reference line La (see FIG. 3), a presser plate 102 for pressing a product roll 14 toward the reference plate 100, a positioning mechanism 104 comprising fluid-pressure cylinders or the like for horizontally moving the reference plate 100 into alignment with the reference line La, a first vertical moving mechanism 106*a* comprising fluid-pressure cylinders or the like for vertically moving the reference plate 100 aligned with the reference line La, a first horizontal guide 108*a* for guiding the reference plate 100 so as to move horizontally, a first vertical guide 110*a* for guiding the reference plate 100 so as to move vertically, a horizontal moving mechanism 112 comprising fluid-pressure cylinders or the like for horizontally moving the presser plate 102, a second vertical moving mechanism 106*b* comprising fluid-pressure cylinders or the like for vertically moving the presser plate 102, a second horizontal guide 108*b* for guiding the presser plate 102 so as to move horizontally, a second vertical guide 110*b* for guiding the presser plate 102 so as to move vertically, and a correction controller 114 for controlling the mechanisms 104, 106*a*, 112, 106*b*.

The position correcting mechanism 72 also includes a plurality of position sensors 116 disposed above the reference plate 100 at respective positions that match the sizes of the product rolls 14. The position sensors 116 supply detection signals to the correction controller 114. In FIG. 5, the leftmost position sensor 116 corresponds to the product roll 14 having the width of 10 inches, and the position sensors 116 disposed successively from the leftmost position sensor 116 toward the rightmost position sensor 116 correspond respectively to the product rolls 14 having widths of 8 inches, 6 inches, 5 inches, and 4 inches, respectively. When size information of a product roll 14 to be wrapped at present is supplied to the correction controller 114, the correction controller 114 decides on a position sensor 116 from among the position sensors 116 depending on the size information. For example, if the product roll 14 having a width of 8 inches is to be wrapped, then the correction controller 114 decides on the second position sensor 116 from the leftmost position sensor 116. Alternatively, if the product roll 14 having a width of 6 inches is to be wrapped, then the correction controller 114 decides on the third position sensor 116 from the leftmost position sensor 116. The reference plate 100 is disposed at an initial position, which is displaced leftwardly from the position shown in FIG. 5. In FIG. 5, electrical connections between the mechanisms 104, 106*a*, 112, 106*b*, the position sensors 116, and the correction controller 114 are omitted from illustration.

Figure 6:
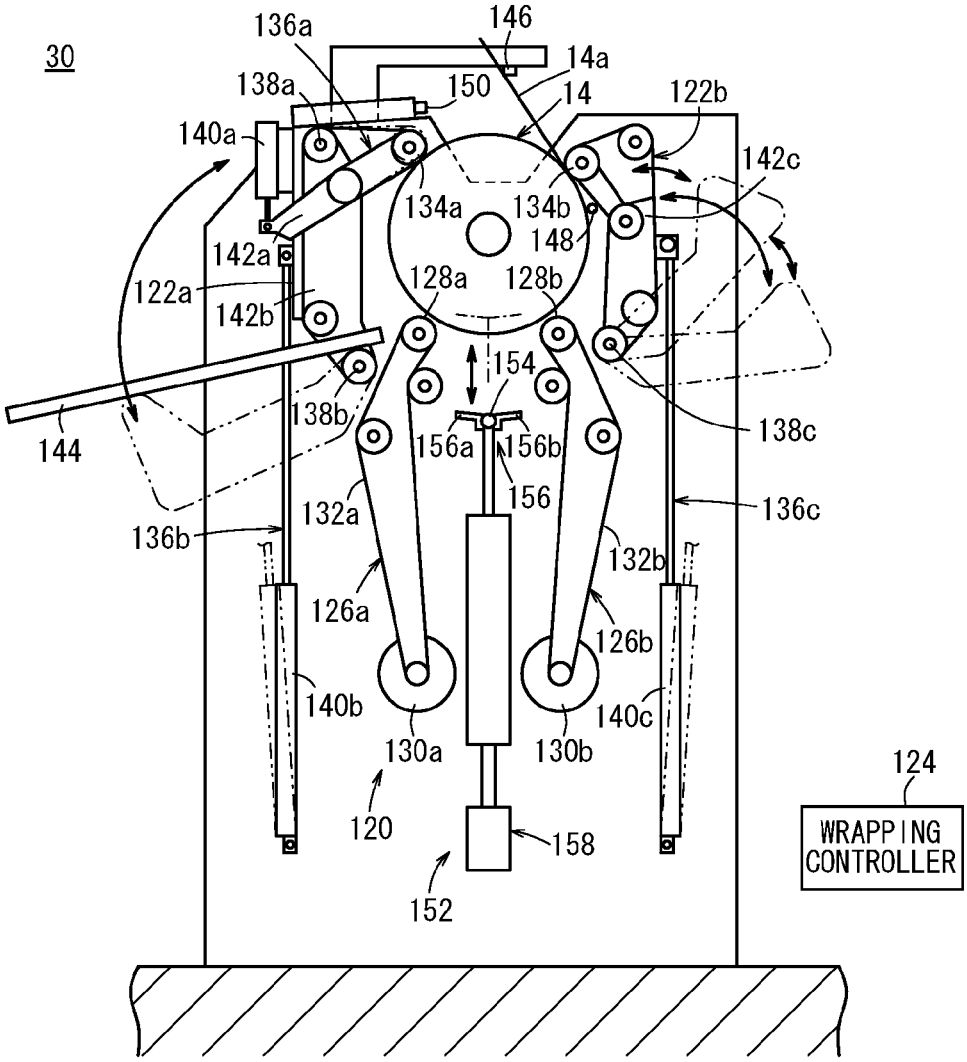
FIG. 6 is a side elevational view of a wrapping unit.

As shown in FIG. 6, the wrapping unit 30 comprises a drive mechanism 120 for turning a product roll 14 at a desired speed and for stopping the product roll 14 at a desired angular position, a first wrapping arm 122*a* and a second wrapping arm 122*b* for wrapping respective opposite sides of the product roll 14, and a wrapping controller 124 for controlling the drive mechanism 120, the first wrapping arm 122*a*, and the second wrapping arm 122*b*. In FIG. 6, electrical connections between mechanisms, sensors, and the wrapping controller 124 are omitted from illustration.

The drive mechanism 120 includes a first driver 126*a* disposed in a downstream region, and a second driver 126*b* disposed in an upstream region. The first driver 126*a* comprises a first drive roller 128*a* held in rolling contact with a lower portion of the product roll 14, a first motor 130*a*, and a first drive force transmitter 132*a* for transmitting the rotational force of the first motor 130*a* to the first drive roller 128*a*. The second driver 126*b* comprises a second drive roller 128*b* held in rolling contact with a lower portion of the product roll 14, a second motor 130*b*, and a second drive force transmitter 132*b* for transmitting the rotational force of the second motor 130*b* to the second drive roller 128*b*. The first drive roller 128*a* and the second drive roller 128*b* are disposed in respective positions below the product roll 14 and are angularly spaced an angle of 30° from a vertical line passing through the center of the product roll 14. At this time, straight lines passing through the center of the product roll 14 and the centers of the first and second drive rollers 128*a*, 128*b* form a central angle of 60° therebetween.

The first wrapping arm 122*a* comprises a first driven roller 134*a* held in rolling contact with an upper portion of the product roll 14, a first turning mechanism 136*a*, and a second turning mechanism 136*b*. The first turning mechanism 136*a* includes a first fluid-pressure cylinder 140*a* and a first arm 142*a* for turning the first driven roller 134*a* about a first pivot shaft 138*a* through an angular range of about 5° to 10°. The second turning mechanism 136*b* includes a second fluid-pressure cylinder 140*b*, and a second arm 142*b* for turning the first wrapping arm 122*a* about a second pivot shaft 138*b* through an angular range of about 100° to 120°. The second pivot shaft 138*b* is adjusted in position, so as to position the first wrapping arm 122*a* below a discharge guide plate 144, which guides the wrapped product roll 14', i.e., the product roll 14 wrapped with the protective sheet 36, onto the discharge conveyor 18, when the first wrapping arm 122*a* is turned to a position that is spaced most widely from the product roll 14. In the present embodiment, the second pivot shaft 138*b* is disposed in a position proximate the first drive roller 128*a*.

The second wrapping arm 122*b* comprises a second driven roller 134*b* held in rolling contact with an upper portion of the product roll 14, and a third turning mechanism 136*c*. The third turning mechanism 136*c* includes a third fluid-pressure cylinder 140*c*, and a third arm 142*c* for turning the second driven roller 134*b* through two angular ranges. More specifically, the two angular ranges include an angular range of about 30° to 50° (an angular range of 45° in the present embodiment) about a third pivot shaft 138*c*, and an angular range of about 80° to 100° (an angular range of 90° in the present embodiment) about the third pivot shaft 138*c*. In the present embodiment, the third pivot shaft 138*c* is disposed in a position proximate the second drive roller 128*b*.

The wrapping unit 30 also includes an extended portion sensor 146 for detecting an extended portion 14*a* of the product roll 14, and more specifically, a portion of the rolled paper of the product roll 14 that includes an exposed lead end thereof as well as a portion spaced from the rolled paper, a leading end sensor 148 for detecting the leading end of a protective sheet 36 that is transported thereto, an ejector nozzle 150 for ejecting air toward a direction in which the extended portion 14*a* extends, and a receiving and discharging mechanism 152 for receiving and discharging the product roll 14.

The receiving and discharging mechanism 152 comprises a V-shaped stage 156 having a pair of wings 156*a*, 156*b*, which are angularly movable, i.e., openable and closable, about a pivot shaft 154 extending in an axial direction from the product roll 14, a V-shaped stage moving mechanism 158 comprising a feed screw mechanism or the like for vertically moving the V-shaped stage 156, and a V-shaped stage turning mechanism, not shown, for turning one of the wings 156*a*, which is disposed downstream with respect to the direction in which the wrapped product roll 14' is discharged. When the V-shaped stage 156 is in an initial state with the wing 156*a* not turned, each of the wings 156*a*, 156*b* is angularly spaced about 70° from a vertical line extending along the V-shaped stage moving mechanism 158, such that the wings 156*a*, 156*b* are angularly spaced 140° from each other. When the wrapped product roll 14' is discharged, the wing 156*a* is turned by the V-shaped stage turning mechanism to an angular position in which the wing 156*a* is angularly spaced 180° from the wing 156*b*. When the wing 156*a* is turned in this manner, the wrapped product roll 14' begins to roll onto the discharge guide plate 144 toward the discharge conveyor 18 (see FIG. 1).

Figure 7:
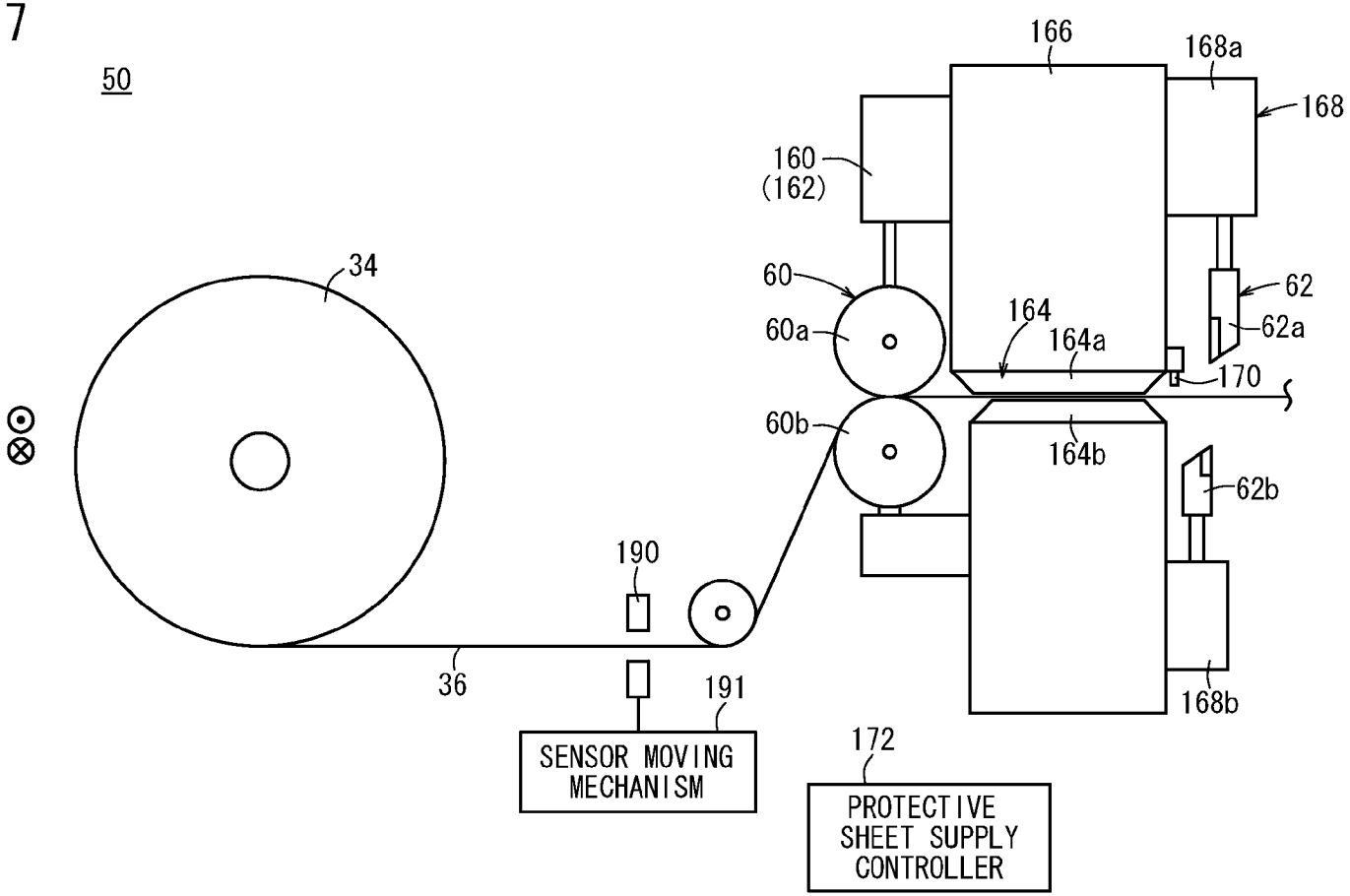
FIG. 7 is a side elevational view of a protective sheet supply mechanism.

As shown in FIG. 7, the protective sheet supply mechanism 50 comprises the sheet roll 34 of the protective sheet 36, the pair of protective sheet supply rollers 60, i.e., an upper supply roller 60*a* and a lower supply roller 60*b*, for unreeling a predetermined length of the protective sheet 36 from the sheet roll 34, a roller rotating mechanism 160 comprising a motor or the like for rotating the upper supply roller 60*a* about its axis, the pair of cutters 62, i.e., an upper cutter 62*a* and a lower cutter 62*b*, for cutting off the unreeled protective sheet 36 at a predetermined length, a pair of pressers 164, i.e., an upper presser 164*a* and a lower presser 164*b*, having respective flat surfaces confronting each other, a presser moving mechanism 166 for vertically moving the upper presser 164*a*, a cutter moving mechanism 168 for moving the cutters 62 toward and away from each other, i.e., an upper cutter moving mechanism 168*a* comprising a fluid-pressure cylinder or the like for vertically moving the upper cutter 62*a*, and a lower cutter moving mechanism 168*b* comprising a fluid-pressure cylinder or the like for vertically moving the lower cutter 62*b*, a leading end sensor 170 disposed on the front portion of a casing of the protective sheet supply mechanism 50, i.e., a portion of the casing that faces the wrapping unit 30, for detecting the leading end of the protective sheet 36, and a protective sheet supply controller 172 for controlling the mechanisms 160, 162, 166, 168. The roller rotating mechanism 160 is controlled by the protective sheet supply controller 172 in order to rotate the protective sheet supply rollers 60 in synchronism with reciprocating movements of the first chuck 64 (see FIG. 2), thereby to unreel the protective sheet 36 from the sheet roll 34. In FIG. 7, electrical connections between the mechanisms 160, 162, 166, 158, the leading end sensor 170, and the protective sheet supply controller 172 are omitted from illustration.

Figure 8:
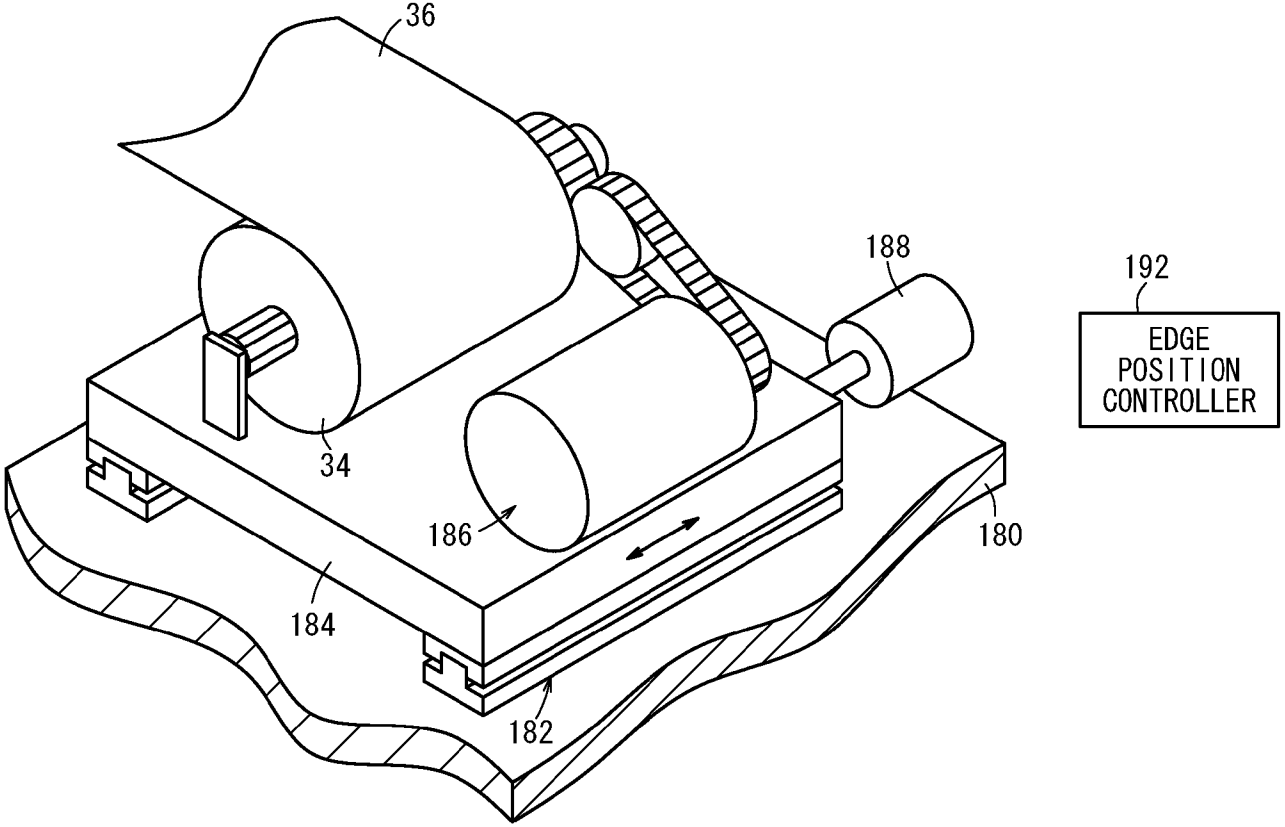
FIG. 8 is a perspective view of an edge position control (EPC) mechanism.

As shown in FIG. 8, the EPC mechanism 52 comprises a table 184 mounted on a base 180 by a pair of LM (Linear Motion) guides 182, the sheet roll 34 of the protective sheet 36 disposed on the table 184, a tensioning mechanism 186 comprising a powder brake, a transmitting mechanism, etc., mounted on the table 184 for angularly tensioning the sheet roll 34 along a direction opposite to the direction in which the protective sheet 36 is unreeled from the sheet roll 34, a table moving mechanism 188 comprising a motor, a ball screw, etc., for moving the table 184 along the LM guides 182, an edge sensor 190 (see FIG. 7) disposed along a feed path of the protective sheet 36 from the sheet roll 34 to the protective sheet supply rollers 60, for detecting a reference edge of the protective sheet 36, i.e., a left edge as viewed in a direction from the sheet roll 34 toward the protective sheet supply rollers 60, a sensor moving mechanism 191 comprising a fluid-pressure cylinder or the like for moving the edge sensor 190 into alignment with the reference line La, which has been set, and an edge position controller 192 for controlling the tensioning mechanism 186, the table moving mechanism 188, and the sensor moving mechanism 191. In FIG. 8, electrical connections between the mechanisms 186, 188, 191, the edge sensor 190, and the edge position controller 192 are omitted from illustration.

The LM guides 182 guide the table 184 in directions along the axis of the sheet roll 34. The edge position controller 192 has an information table, which is used to correct the edge of the protective sheet 36. The information table stores therein information concerning distances that the edge sensor 190 is to move corresponding to reference lines La set by the position correcting mechanism 72 for respective different sizes of the product rolls 14. Based on size information of a product roll 14 to be wrapped, the edge position controller 192 reads the corresponding distance information from the information table, and actuates the sensor moving mechanism 191 based on the read information. When the sensor moving mechanism 191 is actuated by the edge position controller 192, the sensor moving mechanism 191 moves the edge sensor 190 by a distance represented by the information read by the edge position controller 192. Based on a detected value from the edge sensor 190, the edge position controller 192 moves the reference edge of the protective sheet 36 into alignment with the set reference line La.

Figure 9:
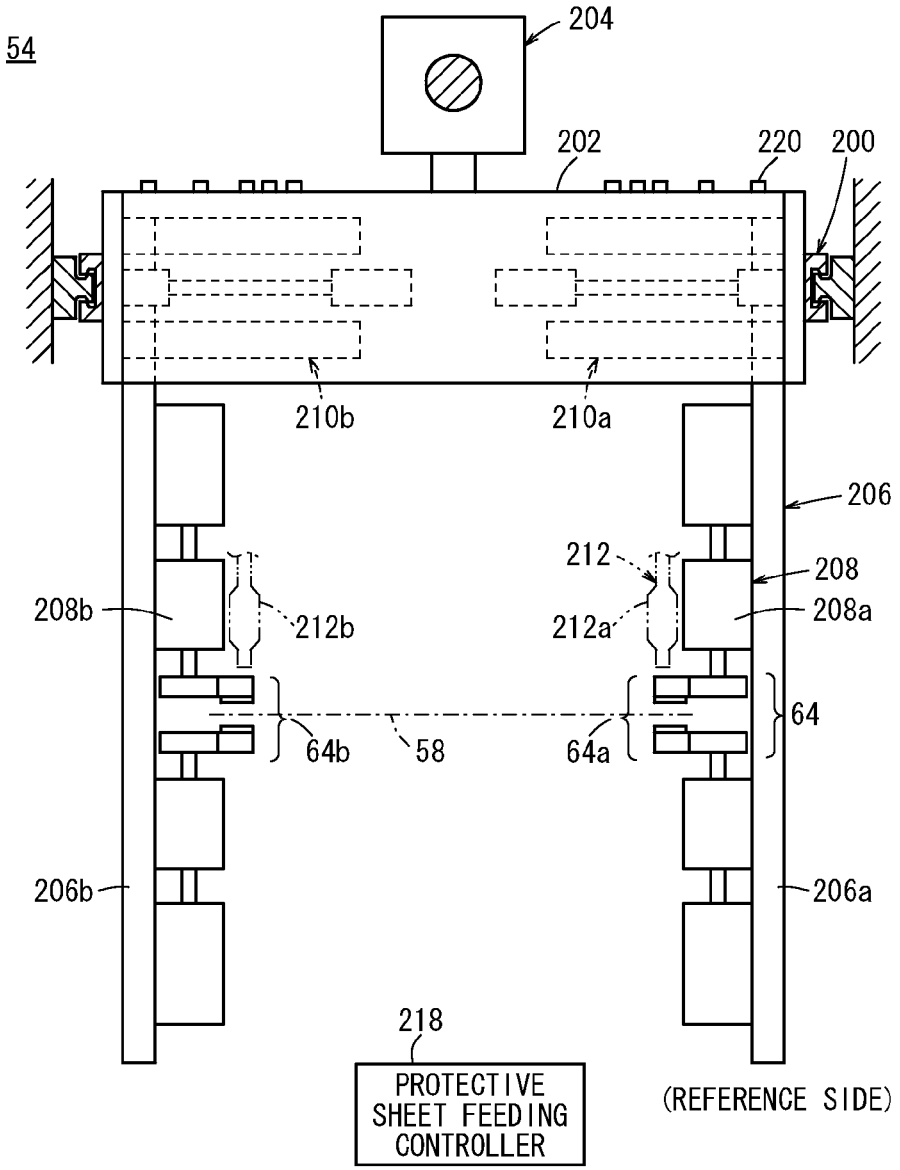
FIG. 9 is a front elevational view of a protective sheet feeding mechanism.

As shown in FIG. 9, the protective sheet feeding mechanism 54 comprises a pair of LM guides 200 mounted on respective side walls of the packaging unit 12, a support plate 202 connected to and installed between the LM guides 200, a reciprocal moving mechanism 204 comprising a feed screw or the like for reciprocally moving the support plate 202 along the LM guides 200 from the position of the protective sheet supply mechanism 50 to the position of the wrapping unit 30, a pair of vertical plates 206, i.e., a reference-side vertical plate 206*a* and an anti-reference-side vertical plate 206*b*, slidably mounted on the support plate 202, and the pair of first chucks 64, i.e., reference-side first chucks 64*a* and anti-reference-side first chucks 64*b*, mounted on respective confronting surfaces of the vertical plates 206. The first chucks 64 operate at least in a first mode and a second mode, as well as in a third mode. In the first mode, the first chucks 64 mechanically grip opposite sides of the leading end of the protective sheet 36 and feed the protective sheet 36 to the wrapping unit 30. In the second mode, the first chucks 64 mechanically grip sides of a portion, preferably an intermediate portion, of the protective sheet 36, other than the leading and trailing ends thereof, and feed the protective sheet 36 to the wrapping unit 30. In the third mode, the first chucks 64 mechanically grip opposite sides of the trailing end of the protective sheet 36 and feed the protective sheet 36 to the wrapping unit 30. In the first mode, the second mode, and the third mode, the first chucks 64 switch between respective gripping positions of the protective sheet 36 before feeding the protective sheet 36 toward the wrapping unit 30. The total stroke by which the first chucks 64 feed the protective sheet 36 to the wrapping unit 30 in the first and second modes, or in the first through third modes, is at least twice the circumferential length of the product roll 14, i.e., at least 6.3 times the diameter of the product roll 14.

The protective sheet feeding mechanism 54 also includes a pair of first opening and closing mechanisms 208 for opening and closing the first chucks 64, i.e., a first reference-side opening and closing mechanism 208*a* comprising an upper fluid-pressure cylinder, an upper guide, a lower fluid-pressure cylinder, and a lower guide for opening and closing the reference-side first chucks 64*a*, and a second anti-reference-side opening and closing mechanism 208*b* comprising an upper fluid-pressure cylinder, an upper guide, a lower fluid-pressure cylinder, and a lower guide for opening and closing the anti-reference-side first chucks 64*b*, a reference-side sliding mechanism 210*a* comprising a feed screw mechanism and a guide for sliding the reference-side vertical plate 206*a* toward and away from the anti-reference-side vertical plate 206*b*, and an anti-reference-side sliding mechanism 210*b* comprising a feed screw mechanism and a guide for sliding the anti-reference-side vertical plate 206*b* toward and away from the reference-side vertical plate 206*a*.

The protective sheet feeding mechanism 54 further includes a pair of suction pads 212 for holding the protective sheet 36 under suction, i.e., a reference-side suction pad 212*a* and an anti-reference-side suction pad 212*b*, a pair of pad moving mechanisms 214 (see FIG. 10) for vertically moving the respective suction pads 212, i.e., a reference-side pad moving mechanism 214*a* comprising a fluid-pressure cylinder, a guide, etc., for vertically moving the reference-side suction pad 212*a* and an anti-reference-side pad moving mechanism 214*b* comprising a fluid-pressure cylinder, a guide, etc., for vertically moving the anti-reference-side suction pad 212*b*, a pair of biasing means 216 for normally biasing the first chucks 64 toward the wrapping unit 30, i.e., a reference-side biasing means 216*a* comprising a tension helical spring or the like for biasing the reference-side first chucks 64*a* toward the wrapping unit 30 and an anti-reference-side biasing means 216*b* comprising a tension helical spring or the like for biasing the anti-reference-side first chucks 64*b* toward the wrapping unit 30, and a protective sheet feeding controller 218 for controlling the above mechanisms and means that make up the protective sheet feeding mechanism 54. Positional relationships between the first chucks 64 and the suction pads 212 will be described later.

As shown in FIG. 9, the protective sheet feeding mechanism 54 also includes a plurality of pairs of position sensors 220 mounted on the support plate 202 at respective positions that match the sizes of the product rolls 14. The position sensors 220 supply detection signals to the protective sheet feeding controller 218. In particular, among the position sensors 220, those which are disposed closely to the reference-side sliding mechanism 210*a* are aligned with the position sensors 116 of the position correcting mechanism 72 (see FIG. 5) described above. Further, among the position sensors 220, those which are disposed closely to the anti-reference-side sliding mechanism 210*b* are symmetrical to the position sensors 220 that are disposed closely to the reference-side sliding mechanism 210*a*, with respect to a longitudinal center of the horizontally elongate support plate 202. When size information of a product roll 14 to be wrapped at present is supplied to the protective sheet feeding controller 218, the protective sheet feeding controller 218 decides on a pair of position sensors 220, depending on the size information, from among the pairs of position sensors 220. The protective sheet feeding controller 218 activates the reference-side sliding mechanism 210*a* and the anti-reference-side sliding mechanism 210*b* so as to move the reference-side vertical plate 206*a* and the anti-reference-side vertical plate 206*b* toward or away from each other. When the protective sheet feeding controller 218 receives detection signals from the position sensors 220 that have been decided on, the protective sheet feeding controller 218 inactivates the reference-side sliding mechanism 210*a* and the anti-reference-side sliding mechanism 210*b*. In this manner, the first chucks 64 are positioned in conformity with the size (i.e., width) of the product roll 14. More specifically, the reference-side first chucks 64*a* are disposed in a position slightly inward from the reference line La set by the position correcting mechanism 72, and the anti-reference-side first chucks 64*b* are disposed in a position that is symmetrical to the position of the reference-side first chucks 64*a*.

Figure 10:
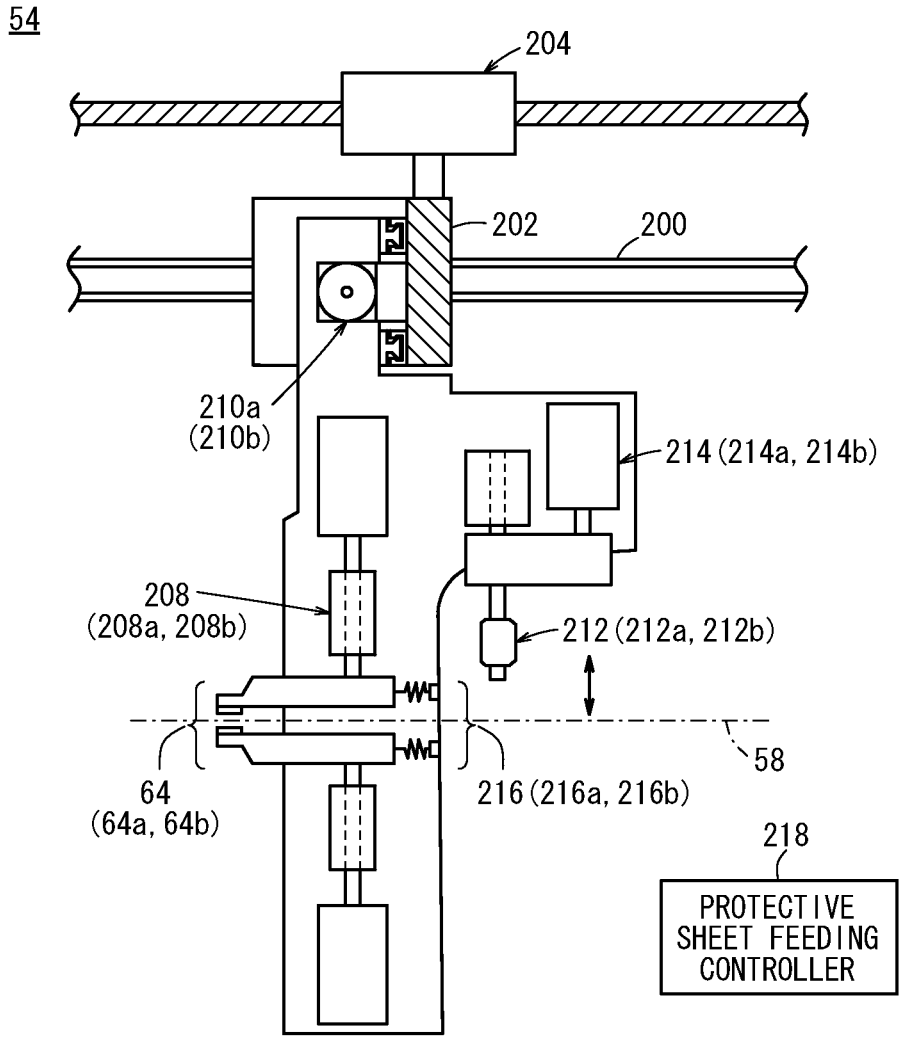
FIG. 10 is a vertical cross-sectional view of the protective sheet feeding mechanism.

The protective sheet feeding controller 218 actuates the reciprocal moving mechanism 204 in order to move the support plate 202 reciprocally so as to cause the first chucks 64 to move respectively through a leading-end position, an intermediate position, and a trailing-end position. The trailing-end position refers to a position proximate a front portion of the protective sheet supply mechanism 50. The leading-end position refers to a position proximate a product roll 14 that is set in the wrapping unit 30. The intermediate position refers to a position where the protective sheet holding mechanism 56 is installed. In FIGS. 9 and 10, electrical connections between the mechanisms, the sensors, and the protective sheet feeding controller 218 are omitted from illustration.

Figure 11:
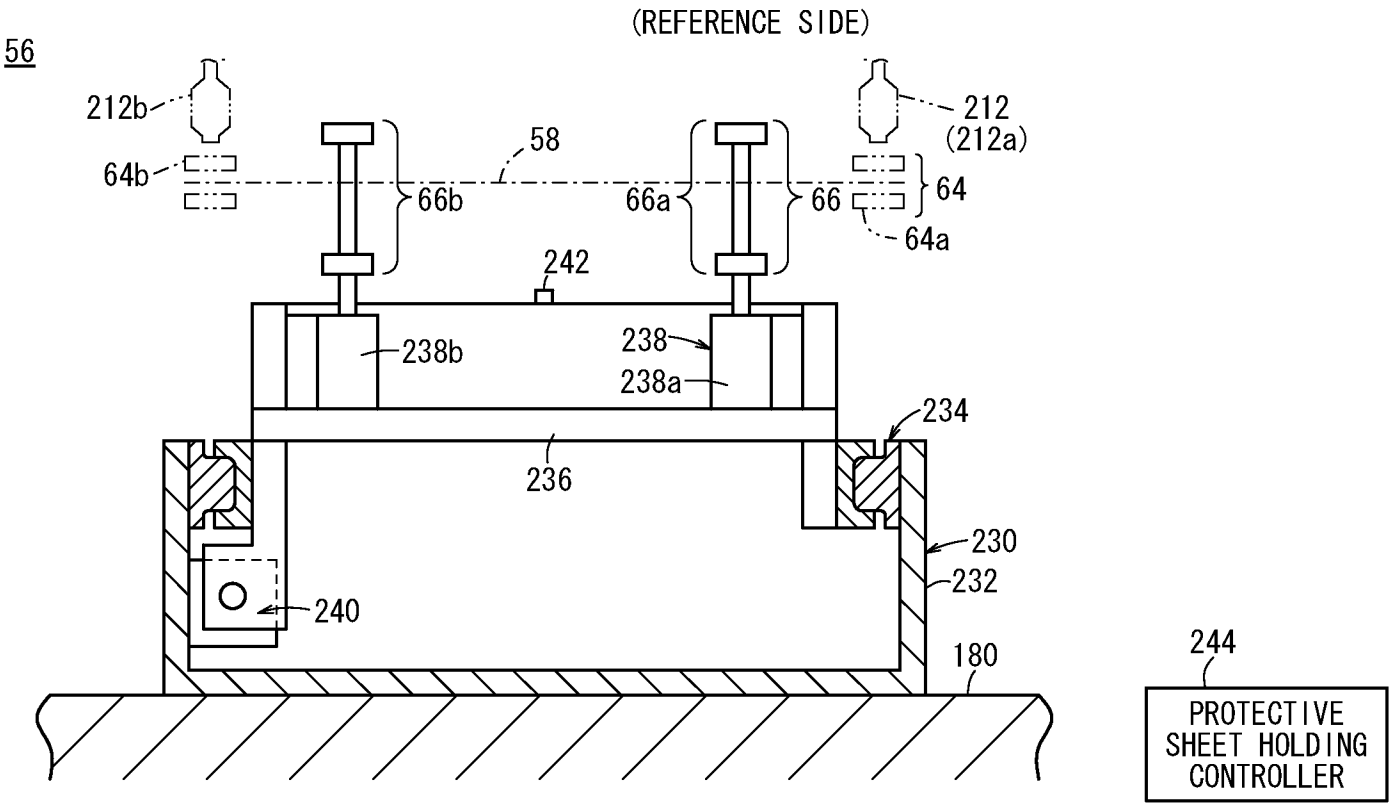
FIG. 11 is a front elevational view of a protective sheet holding mechanism.
Figure 12:
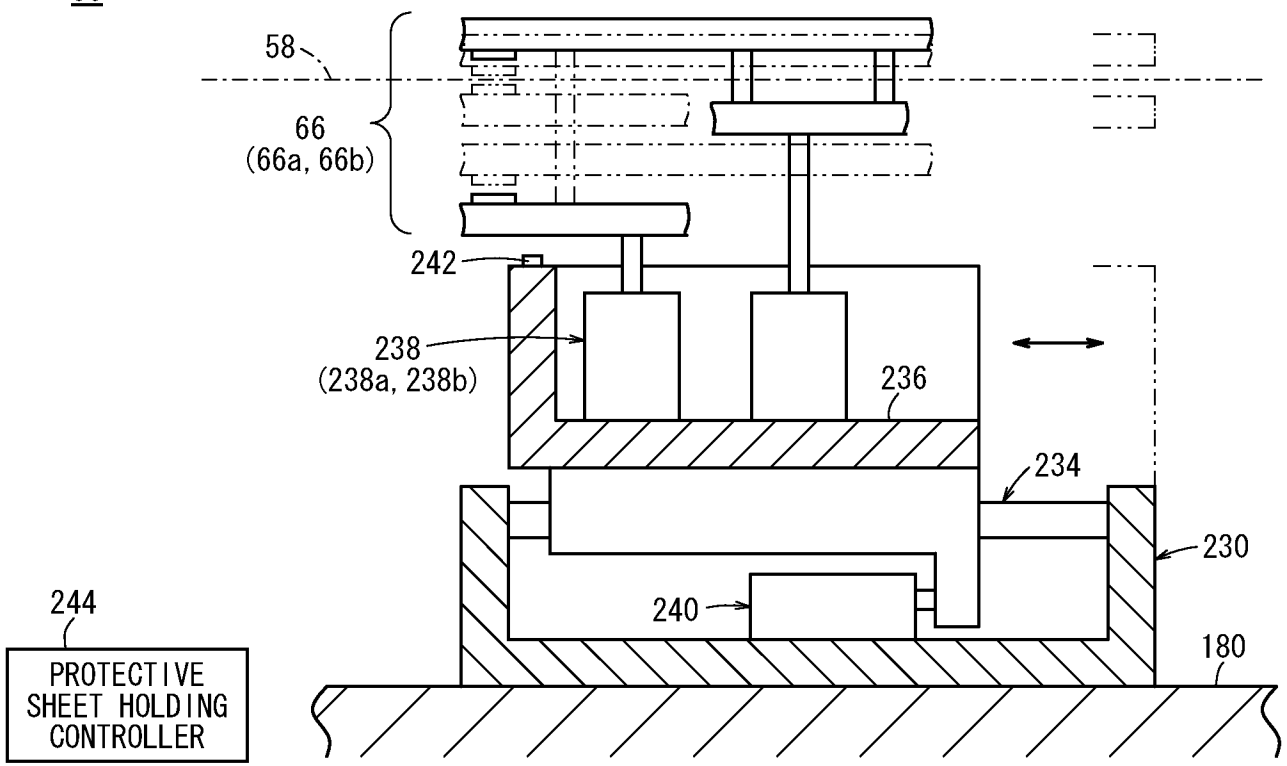
FIG. 12 is a vertical cross-sectional view of the protective sheet holding mechanism.

As shown in FIG. 11, the protective sheet holding mechanism 56 comprises an upwardly open box 230 mounted on a base 180, a pair of LM guides 234 mounted respectively on side walls 232 of the box 230 in confronting relation to each other, a table 236 mounted on and extending between the LM guides 234, the pair of second chucks 66 vertically movably mounted on the table 236, i.e., a reference-side second chuck 66*a* and an anti-reference-side second chuck 66*b*, a pair of second opening and closing mechanisms 238 for opening and closing the respective second chucks 66, i.e., a reference-side second opening and closing mechanism 238*a* comprising an upper fluid-pressure cylinder, a lower fluid-pressure cylinder, etc., for opening and closing the reference-side second chuck 66*a* and an anti-reference-side second opening and closing mechanism 238*b* comprising an upper fluid-pressure cylinder, a lower fluid-pressure cylinder, etc., for opening and closing the anti-reference-side second chuck 66*b*, a table moving mechanism 240 comprising a fluid-pressure cylinder, etc., for moving the table 236 along the LM guides 234, a leading-end sensor 242 (see FIG. 12) for detecting the leading end of the protective sheet 36, and a protective sheet holding controller 244 for controlling the mechanisms 238, 240. The LM guides 234 guide the table 236 along the same direction as the direction in which the protective sheet 36 is fed. In FIGS. 11 and 12, electrical connections between the mechanisms, the sensor, and the protective sheet holding controller 244 are omitted from illustration.

The second opening and closing mechanisms 238 cooperate with the table moving mechanism 240 in order to provide a function to grip the protective sheet 36 with the second chucks 66, as well as a function to retract the second chucks 66 from the protective sheet path line 58 (see FIG. 2). More specifically, for gripping the protective sheet 36, the second opening and closing mechanisms 238 position the second chucks 66, while the second chucks 66 are open, on the protective sheet path line 58, and the table moving mechanism 240 moves the table 236 toward the cutters 62. When the leading end of the protective sheet 36 arrives at the protective sheet holding mechanism 56, the second opening and closing mechanisms 238 close the second chucks 66 so as to grip the front portion of the leading end of the protective sheet 36, which faces toward the wrapping unit 30. For retracting the second chucks 66 from the protective sheet path line 58, the table moving mechanism 240 moves the table 236 toward the wrapping unit 30, and the second opening and closing mechanisms 238 move the second chucks 66 downwardly while the second chucks 66 are closed, thereby retracting the second chucks 66 from the protective sheet path line 58.

The horizontal distance between the second chucks 66 must be smaller than the horizontal distance between the first chucks 64 of the protective sheet feeding mechanism 54, and more particularly, the horizontal distance between the first chucks 64, which are positioned for use with a sheet roll 34 that has the smallest width. The second chucks 66 may be combined with sliding mechanisms (not shown), which are similar to the reference-side sliding mechanism 210*a* and the anti-reference-side sliding mechanism 210*b* for moving the first chucks 64, in order for the protective sheet holding mechanism 56 to fix the protective sheet 36 even if the protective sheet 36 has a large width.

Positional relationships between the first chucks 64 and the suction pads 212 of the protective sheet feeding mechanism 54 will be described below.

The suction pads 212 are initially positioned more closely to the wrapping unit 30 than the first chucks 64 along a direction in which the first chucks 64 move forward, and are in positions lifted upwardly from the first chucks 64. When opposite sides of an intermediate portion of the protective sheet 36 are gripped by the first chucks 64, the suction pads 212 are moved by the pad moving mechanisms 214 downwardly to a lowered position, which is about 5 mm lower than the first chucks 64 (see FIG. 10). When the suction pads 212 reach the lowered position, the suction pads 212 begin to hold the protective sheet 36 under suction. Then, the suction pads 212 are moved upwardly to a position having the same height as the first chucks 64, i.e., the protective sheet 36 gripped by the first chucks 64. The leading end of the protective sheet 36 is kept flat by the suction pads 212, without drooping. At this time, the smallest distance between the point where the first chucks 64 grip the protective sheet 36 and the point where the suction pads 212 hold the protective sheet 36 is essentially the same as the distance between the trailing-end position and the intermediate position, as referred to above. In other words, while the second chucks 66 of the protective sheet holding mechanism 56 grip the front portion of the leading end of the protective sheet 36, which faces toward the wrapping unit 30, and the first chucks 64 are in the trailing-end position gripping opposite sides of the intermediate portion of the protective sheet 36, the points where the suction pads 212 hold the protective sheet 36 are positioned on opposite sides of the leading end of the protective sheet 36. Because of the above positional relationship, when the first chucks 64 grip opposite sides of the leading end of the protective sheet 36, the suction pads 212 are positioned forwardly of the protective sheet 36 and do not hold the protective sheet 36 under suction.

As shown in FIG. 2, the tape supply unit 42 includes a tape roll 250 in the form of a rolled elongate adhesive tape. An adhesive tape strip is unreeled at a certain length from the tape roll 250 by a known mechanism, and then the adhesive tape strip is cut into an adhesive tape 40 having a prescribed length. The tape supply unit 42 comprises a mechanism for supplying the adhesive tape 40 from the tape roll 250, a tape feeding mechanism for feeding the adhesive tape 40 to the protective sheet path line 58, and a tape supply controller 254 for controlling such mechanisms. The adhesive tape 40 may have an end folded back through 180°, so that the adhesive tape 40 can easily be peeled off from the protective sheet 36 when the wrapped product roll 14' is used.

Operation of the product roll packaging apparatus 10 according to the present embodiment, particularly in relation to the first through third modes of operation of the first chucks 64, will be described below with reference to the flowcharts shown in FIGS. 13 and 14 and the views shown in FIGS. 15A through 15D and 16A through 16D.

Figure 13:
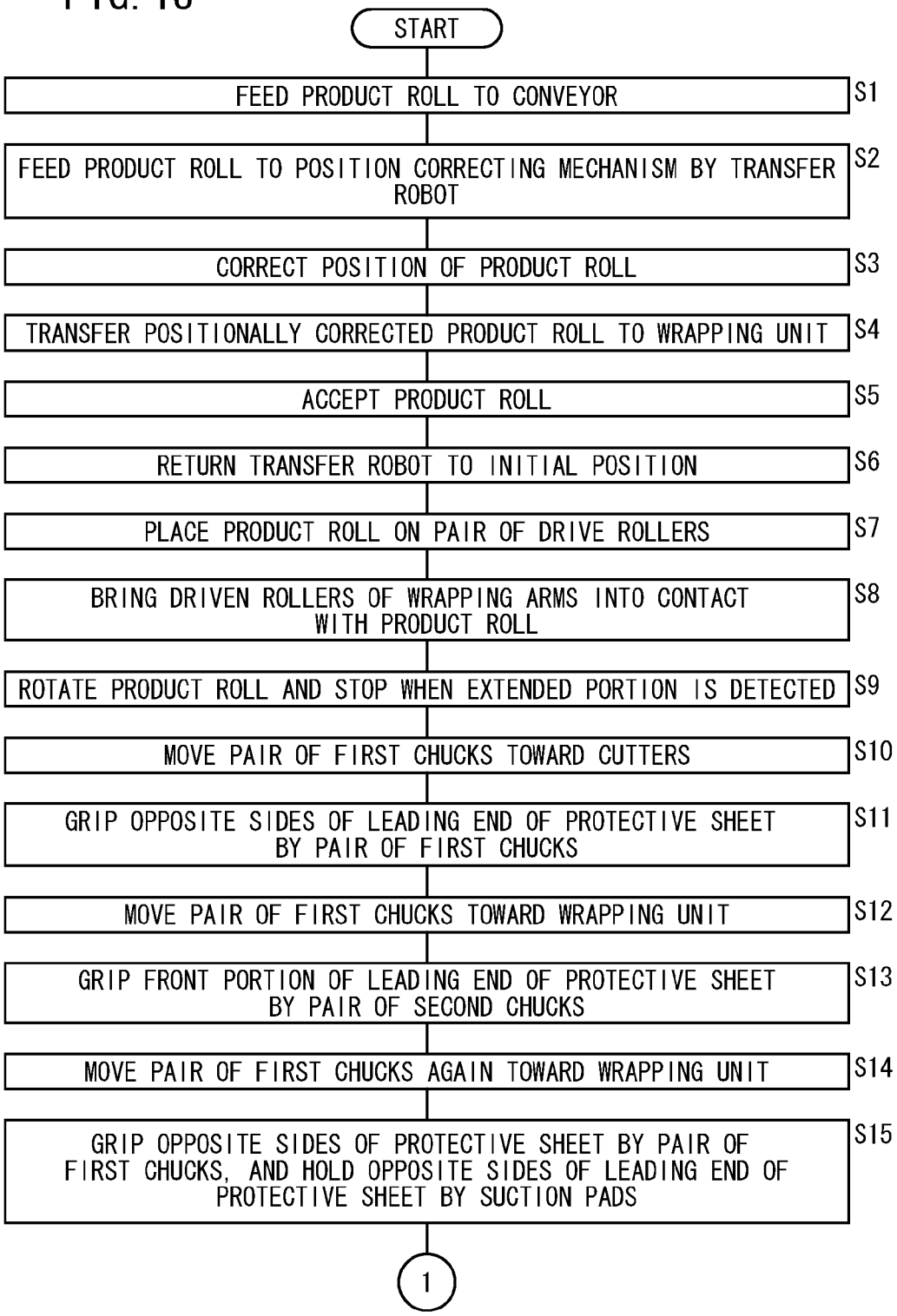
FIG. 13 is a flowchart of a first part of an operation sequence of the product roll packaging apparatus according to the embodiment of the present invention.

In step S1 shown in FIG. 13, six product rolls 14, which have been supplied, are delivered successively to the first through sixth conveyors 20*a* through 20*f*. More specifically, the first through six conveyor controllers 22*a* through 22*f* initially actuate the corresponding first through sixth conveyors 20*a* through 20*f* to operate at equal speeds, so as to deliver the product rolls 14 successively along and to the first through sixth conveyors 20*a* through 20*f*. Then, the first through six conveyor controllers 22*a* through 22*f* control the corresponding first through sixth conveyors 20*a* through 20*f* individually, so as to decelerate and stop at a suitable timing to hold the product rolls 14 at respective positions depending on the widths thereof, i.e., to hold the widthwise centers of the product rolls 14 in alignment with respective central positions of the first through sixth conveyors 20*a* through 20*f*.

Subsequently, the first through six packaging units 12*a* through 12*f* are individually operated to package the product rolls 14. More specifically, the first through six packaging units 12*a* through 12*f* operate substantially synchronously in order to transfer the product rolls 14 with the transfer units 32, wrap the product rolls 14 with respective protective sheets 36, apply adhesive tapes 40 to the protective sheets 36, and discharge the wrapped product rolls 14' onto the discharge conveyor 18.

Therefore, operations of one of the packaging units 12 will be described primarily below.

In step S2, the transfer robot 74 of the transfer unit 32 transfers the product roll 14 on the conveyor 20 to the position correcting mechanism 72. More specifically, when the product roll 14 is positioned in a central position on the conveyor 20, the transfer controller 94 actuates the feeding mechanism 92 to move the transfer robot 74 to the conveyor 20, based on an output signal from the conveyor controller 22, or based on a detection signal from a position sensor, not shown. Thereafter, the transfer controller 94 actuates the first turning mechanisms 86 and the second turning mechanisms 88 to lift the product roll 14, and then actuates the feeding mechanism 92 to transfer the product roll 14 from the conveyor 20 to the position correcting mechanism 72.

In step S3, when the product roll 14 is transferred to the position correcting mechanism 72 by the transfer robot 74, the position correcting mechanism 72 corrects the position of the product roll 14 held by the transfer robot 74. More specifically, the correction controller 114 actuates the first vertical moving mechanism 106*a* to move the reference plate 100 upwardly to a position confronting an end face (the left end face as shown in FIGS. 3 and 5) of the product roll 14. Thereafter, the correction controller 114 actuates the positioning mechanism 104 to move the reference plate 100 horizontally (to the right as shown in FIGS. 3 and 5). When the correction controller 114 receives a detection signal from the position sensor 116 that has been decided on, the correction controller 114 stops actuating the positioning mechanism 104. At this time, the reference plate 100 is positioned on the reference line La and matches the width of the product roll 14.

Thereafter, the correction controller 114 actuates the second vertical moving mechanism 106*b* to move the presser plate 102 upwardly into a position confronting the other end face (the right end face as shown in FIGS. 3 and 5) of the product roll 14. Then, the correction controller 114 actuates the horizontal moving mechanism 112 to move the presser plate 102 horizontally (to the left as shown in FIGS. 3 and 5) into contact with the product roll 14, thereby pressing the product roll 14 toward the reference plate 100. The left end face, i.e., the reference end face, of the product roll 14 is thus brought into alignment with a vertical plane including the reference line La. In other words, the product roll 14 is positioned in a widthwise manner with respect to the vertical plane including the reference line La. At this time, the product roll 14 is positioned in a widthwise manner with respect to the vertical plane, with an error of up to 0.2 mm. In the illustrated embodiment, the position correcting mechanism 72 is located at an intermediate position between the conveyor 20 and the wrapping unit 30. However, the position correcting mechanism 72 may be located above the conveyor 20, so as to shorten the time required to correct the position of the product roll 14, and for reducing the overall size of the product roll packaging apparatus 10.

In step S4, the transfer robot 74 feeds the product roll 14, which has been corrected in position, to the wrapping unit 30.

In step S5, the wrapping controller 124 accepts the product roll 14 fed by the transfer robot 74. In order to accept the product roll 14, the wrapping controller 124 actuates the V-shaped stage moving mechanism 158 to move the V-shaped stage 156 upwardly, and also actuates the second turning mechanism 136*b* of the first wrapping arm 122*a* and the third turning mechanism 136*c* of the second wrapping arm 122*b*, so as to move the first wrapping arm 122*a* and the second wrapping arm 122*b* into respective spaced apart positions such that the first driven roller 134*a* and the second driven roller 134*b* are widely spaced from each other. At this time, the V-shaped stage 156 remains in its initial state. Thereafter, the transfer robot 74 places the product roll 14 onto the V-shaped stage 156, whereupon the product roll 14 is received in the wrapping unit 30.

In step S6, the transfer robot 74 is returned to its initial position, e.g., the position of the position correcting mechanism 72. More specifically, the two pairs of arms 78 of the transfer robot 74 are moved away from each other by the transfer controller 94, thus spacing the rollers 76 away from the product roll 14, which is supported on the V-shaped stage 156 only. Thereafter, the transfer robot 74 is moved upwardly by the transfer controller 94, and is returned to the position of the position correcting mechanism 72 to wait for the arrival of a next product roll 14.

In step S7, the wrapping controller 124 actuates the V-shaped stage moving mechanism 158 to move the V-shaped stage 156 downwardly, thereby leaving the received product roll 14 on the first drive roller 128*a* and the second drive roller 128*b* of the drive mechanism 120.

Then, in step S8, the wrapping controller 124 actuates the second turning mechanism 136*b* of the first wrapping arm 122*a* and the third turning mechanism 136*c* of the second wrapping arm 122*b* to move the first wrapping arm 122*a* and the second wrapping arm 122*b* toward each other, thereby bringing the first driven roller 134*a* and the second driven roller 134*b* into contact with an upper portion of the product roll 14.

In step S9, the wrapping controller 124 rotates the product roll 14 temporarily and then stops rotation of the product roll 14 based on a detection signal from the extended portion sensor 146, when the extended portion sensor 146 detects the extended portion 14*a* of the product roll 14. More specifically, the wrapping controller 124 actuates the first turning mechanism 136*a* of the first wrapping arm 122*a* so as to space the first driven roller 134*a* from the product roll 14. Then, the wrapping controller 124 rotates the first drive roller 128*a* and the second drive roller 128*b* in order to rotate the product roll 14 clockwise in FIG. 6 about its axis. When the extended portion 14*a* of the product roll 14 is detected by the extended portion sensor 146 upon rotation of the product roll 14, or in other words, when the extended portion 14*a* of the product roll 14 is directed toward the protective sheet path line 58, the wrapping controller 124 stops rotation of the first drive roller 128*a* and the second drive roller 128*b*, thereby holding the product roll 14 at rest in the wrapping unit 30. If the angular position of the product roll 14 is kept sufficiently stable when the product roll 14 is transferred by the transfer robot 74, then the wrapping controller 124 may stop the first drive roller 128*a* and the second drive roller 128*b* irrespective of the detection signal from the extended portion sensor 146.

Figure 15A:
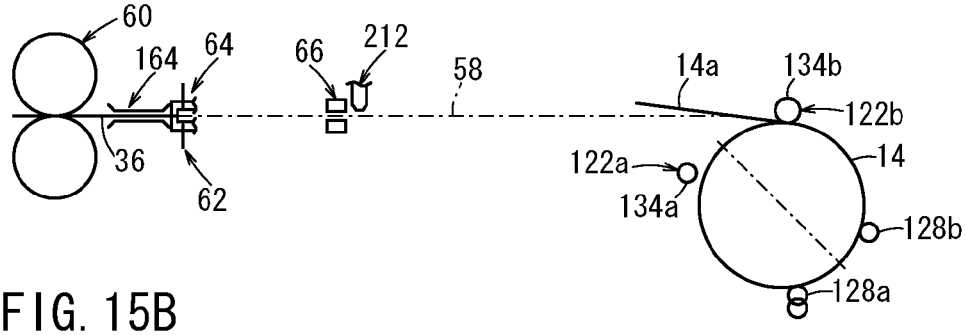
FIGS. 15A through 15D are schematic side elevational views showing a first part of a manner of operation of the product roll packaging apparatus according to the embodiment of the present invention.

In step S10, as shown in FIG. 15A, the protective sheet feeding controller 218 actuates the reciprocal moving mechanism 204 so as to move the first chucks 64 toward the cutters 62, up to a position where the first chucks 64 are capable of gripping opposite sides of the leading end of the protective sheet 36.

In step S11, the protective sheet feeding controller 218 actuates the first opening and closing mechanisms 208 to cause the first chucks 64 to grip opposite sides of the leading end of the protective sheet 36. At this time, since the leading end of the protective sheet 36 has been paid out from the front end of the protective sheet supply mechanism 50, either because the protective sheet 36 was cut off in a previous packaging process or according to initial settings, the leading end of the protective sheet 36 can be gripped by the first chucks 64.

Initial settings of the protective sheet 36 are established as follows. The protective sheet supply controller 172 actuates the roller rotating mechanism 160 to rotate the protective sheet supply rollers 60 so as to pay out a certain length of the protective sheet 36 from the sheet roll 34. When the leading end of the protective sheet 36 is detected by the leading end sensor 170, the protective sheet supply controller 172 outputs a detection signal to the protective sheet feeding controller 218 of the protective sheet feeding mechanism 54. At the same time, the protective sheet supply controller 172 inactivates the roller rotating mechanism 160 and actuates the presser moving mechanism 166 in order to bring the pressers 164 together to sandwich the protective sheet 36 therebetween, thereby temporarily stopping the protective sheet 36.

Then, the protective sheet supply controller 172 reverses the presser moving mechanism 166 in order to spread the pressers 164 away from each other, thereby releasing the protective sheet 36. After opposite sides of the leading end of the protective sheet 36 have been gripped by the first chucks 64, the protective sheet 36 is pulled toward the wrapping unit 30 over a small distance of about 5 mm, for example, by the biasing means 216, which biases the first chucks 64. It is assumed that, when the protective sheet supply rollers 60 make one revolution, the protective sheet 36 is paid out by a length or stroke of Sta, and when the first chucks 64 pull the protective sheet 36 upon rotation of the protective sheet supply rollers 60, the protective sheet 36 is pulled by a length or stroke of Stb. The stroke Stb is longer than the stroke Sta, because the first chucks 64 are displaced toward the wrapping unit 30 by the biasing means 216. The protective sheet 36, which is gripped by the first chucks 64, thus is kept taut under tension, without becoming slack or experiencing warpage.

Figure 15B:
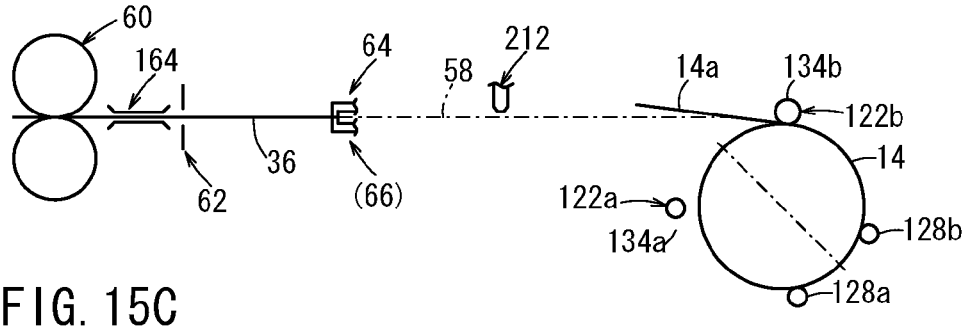
Figure 15C:
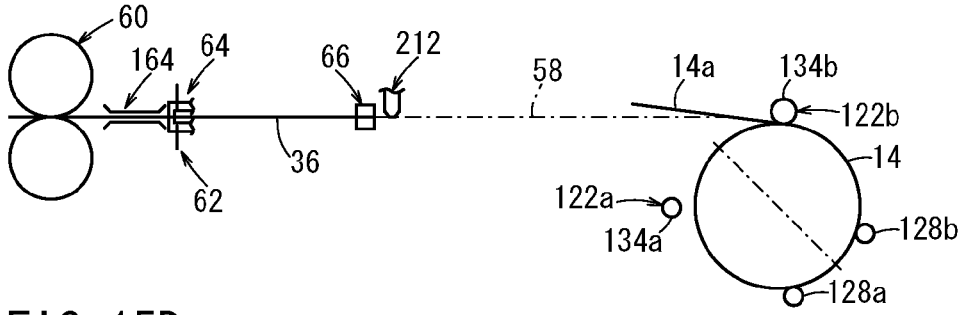

In step S12, the protective sheet feeding controller 218 actuates the reciprocal moving mechanism 204 to move the first chucks 64, which grip opposite sides of the leading end of the protective sheet 36, toward the intermediate position, as shown in FIG. 15B. More specifically, the second chucks 66 of the protective sheet holding mechanism 56 are held open by the second opening and closing mechanisms 238 and positioned on the protective sheet path line 58. At this time, the protective sheet 36 that is paid out from the sheet roll 34 has the reference edge thereof controlled in alignment with the reference line La by the EPC mechanism 52. The protective sheet 36 is thus fed while the protective sheet 36 is positioned highly accurately in a widthwise manner with an error of up to 0.2 mm. When the leading end of the protective sheet 36 is detected by the leading-end sensor 242 of the protective sheet holding mechanism 56, the leading-end sensor 242 applies the detection signal thereof to the protective sheet feeding controller 218, which inactivates the first chucks 64 to stop feeding the protective sheet 36 in response to the signal from the leading-end sensor 242. In FIG. 15B, the second chucks 66 are omitted from illustration.

In step S13, the protective sheet holding controller 244 actuates the second opening and closing mechanisms 238 in order to close the second chucks 66 and grip the front portion of the leading end of the protective sheet 36, which faces toward the wrapping unit 30.

In step S14, the protective sheet feeding controller 218 actuates the first opening and closing mechanisms 208 to open the first chucks 64, thereby releasing the protective sheet 36, and actuates the reciprocal moving mechanism 204 to move the first chucks 64, which have released the protective sheet 36, again toward the cutters 62. The above operating sequence of the first chucks 64 corresponds to the first mode of operation.

In step S15, the protective sheet feeding controller 218 actuates the first opening and closing mechanisms 208 to close the first chucks 64, so as to grip opposite sides of an intermediate portion of the protective sheet 36. The protective sheet feeding controller 218 actuates the pad moving mechanisms 214 to cause the suction pads 212 to hold opposite sides of the leading end of the protective sheet 36 under suction (see FIG. 15C).

Figure 14:
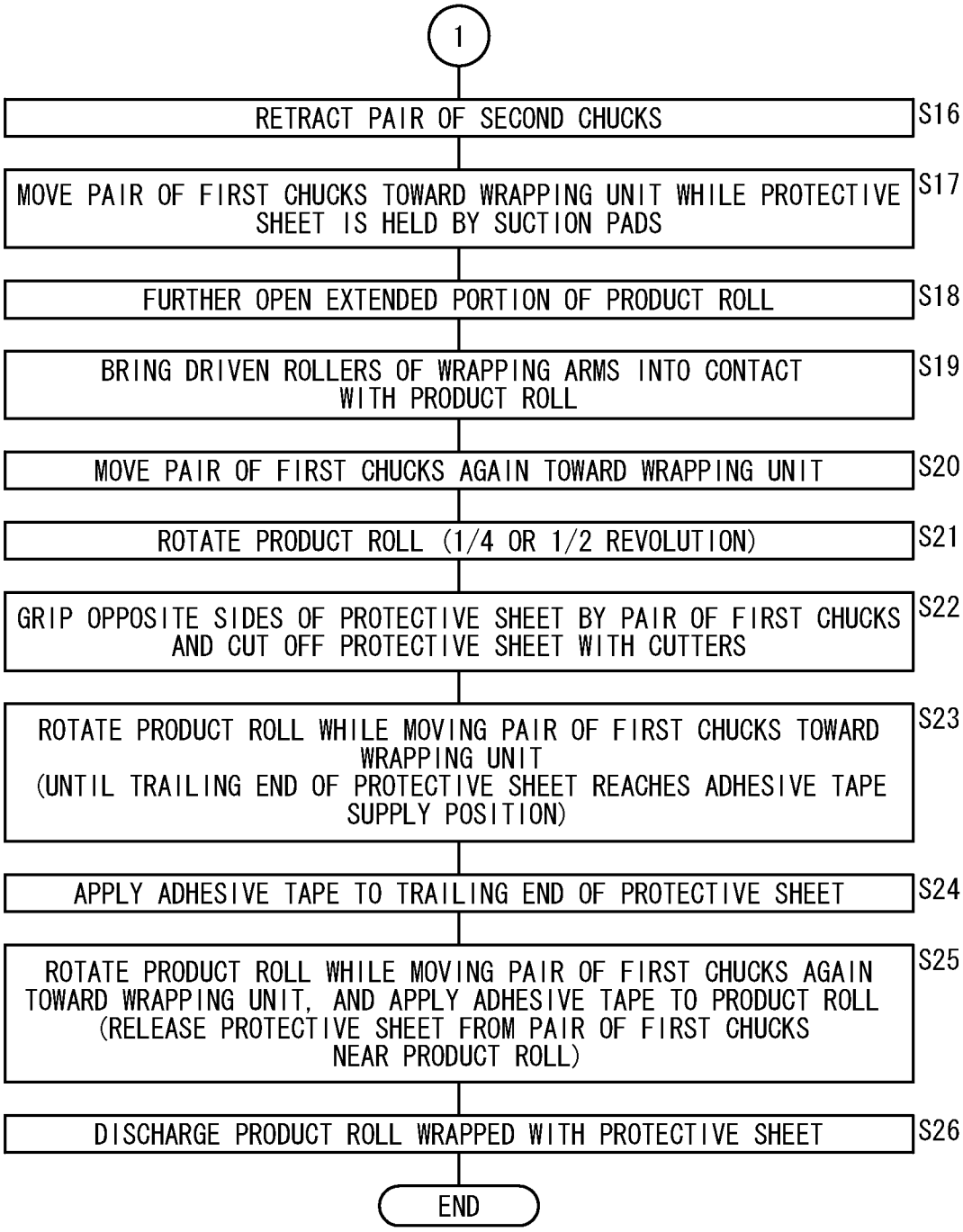
FIG. 14 is a flowchart of a second part of the operation sequence of the product roll packaging apparatus according to the embodiment of the present invention.
Figure 15D:
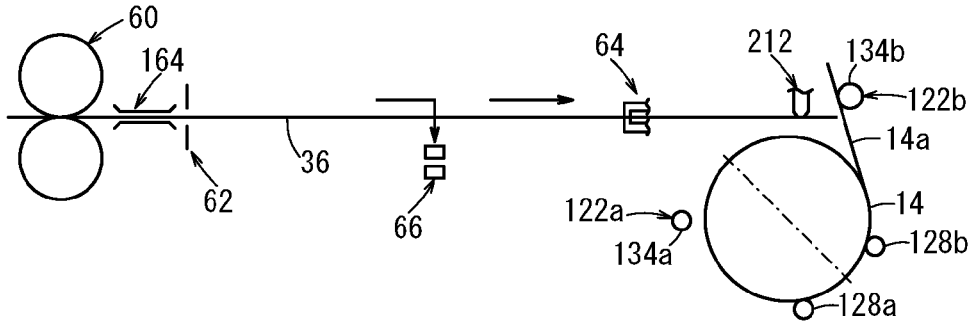

In step S16 shown in FIG. 14, the protective sheet holding controller 244 retracts the second chucks 66 away from the protective sheet path line 58, as shown in FIG. 15D. More specifically, the protective sheet holding controller 244 actuates the table moving mechanism 240 and the second opening and closing mechanisms 238 to move the table 236 toward the wrapping unit 30, and to move the second chucks 66 downwardly.

In step S17, the protective sheet feeding controller 218 actuates the reciprocal moving mechanism 204 to move the first chucks 64 toward the wrapping unit 30. More specifically, the protective sheet feeding controller 218 feeds the protective sheet 36, which is gripped by the first chucks 64, until the leading end of the protective sheet 36 reaches the position of the leading end of the protective sheet path line 58. Since the protective sheet 36 is paid out from the sheet roll 34, and the reference edge of the protective sheet 36 is controlled by the EPC mechanism 52 to match the reference line La, the protective sheet 36 is fed while the protective sheet 36 is positioned highly accurately in a widthwise manner, with an error up to 0.2 mm. At this time, since opposite sides of the leading end of the protective sheet 36 are held under suction by the suction pads 212, the protective sheet 36 is fed flatwise without the leading end thereof sagging.

In step S18, the wrapping controller 124 is operated to further open the extended portion 14*a* of the product roll 14, as shown in FIG. 15D. More specifically, the wrapping controller 124 actuates the third turning mechanism 136*c* of the second wrapping arm 122*b* in order to turn the second wrapping arm 122*b* through an angle of about 45°, and also actuates the ejector nozzle 150 to eject air in a direction that causes the extended portion 14*a* to open, i.e., in a direction toward the second wrapping arm 122*b*. The extended portion 14*a* is thus opened to increase the ease with which the leading end of the protective sheet 36 can be entered between the extended portion 14*a* and the rolled paper of the product roll 14.

Figure 16A:
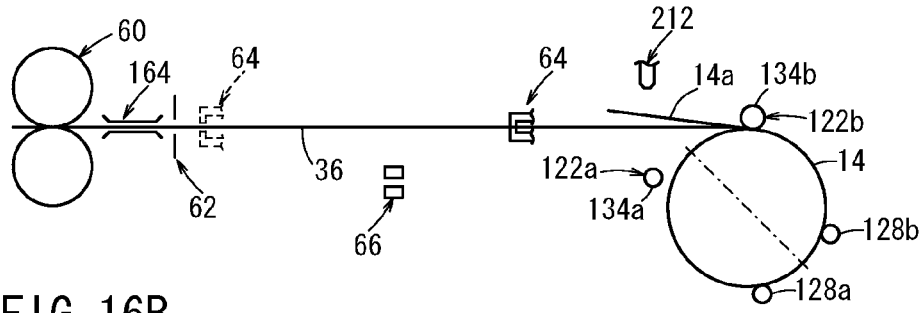
FIGS. 16A through 16D are schematic side elevational views showing a second part of the manner of operation of the product roll packaging apparatus according to the embodiment of the present invention.

In step S19, the first driven roller 134*a* of the first wrapping arm 122*a* and the second driven roller 134*b* of the second wrapping arm 122*b* are brought into contact with the product roll 14, as shown in FIG. 16A. More specifically, the protective sheet 36 is fed toward the wrapping unit 30. When the leading end sensor 148 of the wrapping unit 30 detects the leading end of the protective sheet 36, the leading end sensor 148 applies detection signals to the protective sheet feeding controller 218 and to the wrapping controller 124. Based on the detection signal from the leading end sensor 148, the protective sheet feeding controller 218 stops the first chucks 64 from feeding the protective sheet 36, stops the suction pads 212 from holding the protective sheet 36 under suction, and actuates the pad moving mechanisms 214 to move the suction pads 212 upwardly to respective upper stroke end positions thereof. At this time, the suction pads 212 may be moved parallel to the protective sheet 36, or moved angularly so as to avoid interference with the extended portion 14*a* of the product roll 14.

Based on the detection signal from the leading end sensor 148, the wrapping controller 124 actuates the first turning mechanism 136*a* of the first wrapping arm 122*a* and the third turning mechanism 136*c* of the second wrapping arm 122*b*, so as to bring the first driven roller 134*a* and the second driven roller 134*b* into contact with the product roll 14. At this time, the leading end of the protective sheet 36 is sandwiched between the extended portion 14*a* and the rolled paper of the product roll 14. More specifically, by means of the second driven roller 134*b*, the protective sheet 36 is sandwiched at a position, which is spaced from the leading end by a distance ranging from 50 to 100 mm, between the extended portion 14*a* and the rolled paper of the product roll 14. Consequently, the leading end of the protective sheet 36 is prevented from being displaced. An ejector nozzle, not shown, may be provided to apply air to the surface of the extended portion 14*a*, so as to force the extended portion 14*a* toward the rolled paper of the product roll 14.

Figure 16B:
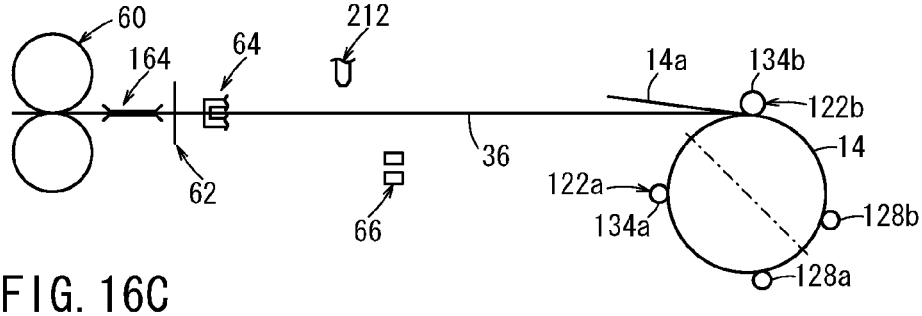

In step S20, the protective sheet feeding controller 218 actuates the first opening and closing mechanisms 208 to open the first chucks 64, thereby releasing the protective sheet 36, and actuates the reciprocal moving mechanism 204 to move the first chucks 64, which have released the protective sheet 36, again toward the cutters 62, as shown in FIG. 16B. In this case, the first chucks 64 are moved back to a position where the first chucks 64 are capable of gripping opposite sides of a portion of the protective sheet 36, which will become the trailing end thereof when the portion is cut off.

In step S21, the wrapping controller 124 rotates the first drive roller 128*a* and the second drive roller 128*b* to rotate the product roll 14 about its axis. Upon rotation of the product roll 14, the protective sheet 36 is wrapped around the product roll 14. When the product roll 14 completes one-quarter or one-half of its full revolution, the wrapping controller 124 stops rotating the first drive roller 128*a* and the second drive roller 128*b*. The above operating sequence of the first chucks 64 corresponds to the second mode of operation.

In step S22, the protective sheet feeding controller 218 actuates the first opening and closing mechanisms 208 to close the first chucks 64 and to grip opposite sides of the portion of the protective sheet 36, which will become the trailing end thereof when the portion is cut off. The protective sheet supply controller 172 actuates the presser moving mechanism 166 to move the pressers 164 so as to grip the protective sheet 36, and also actuates the cutter moving mechanism 168 to move the cutters 62 in order to cut off the protective sheet 36. At this time, since opposite sides of the trailing end of the protective sheet 36 are gripped by the first chucks 64, the trailing end of the protective sheet 36 is prevented from sagging downwardly.

Figure 16C:
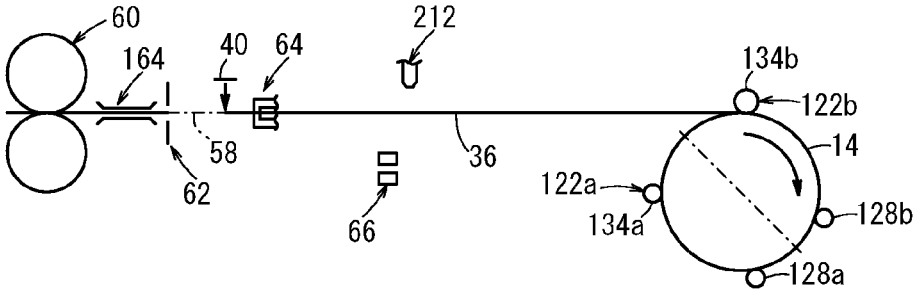

In step S23, as shown in FIG. 16C, the wrapping controller 124 rotates the first drive roller 128*a* and the second drive roller 128*b* again in order to rotate the product roll 14 about its axis, and the protective sheet feeding controller 218 actuates the reciprocal moving mechanism 204 to move the first chucks 64 toward the wrapping unit 30, while the first chucks 64 apply a constant tension to the protective sheet 36. When the trailing end of the protective sheet 36 reaches a position where the adhesive tape 40 is to be applied, the wrapping controller 124 stops rotating the first drive roller 128*a* and the second drive roller 128*b*, and also stops moving the first chucks 64.

In step S24, the tape supply unit 42 unwinds the adhesive tape 40 by a certain length from the tape roll 250, feeds the unreeled adhesive tape 40 to the protective sheet path line 58, and applies a portion of the adhesive tape 40 to a central area of the trailing end of the protective sheet 36.

Figure 16D:
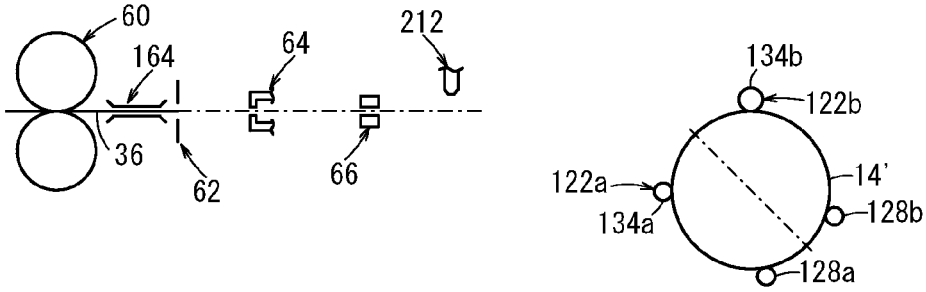

In step S25, as shown in FIG. 16D, the wrapping controller 124 rotates the first drive roller 128*a* and the second drive roller 128*b* to rotate the product roll 14 about its axis, and the protective sheet feeding controller 218 actuates the reciprocal moving mechanism 204 to move the first chucks 64 toward the wrapping unit 30, while the first chucks 64 apply a constant tension to the protective sheet 36. At this time, as the product roll 14 rotates, the protective sheet 36 is wrapped around the product roll 14. Prior to the position at which the first chucks 64 grip the protective sheet 36 reaching the product roll 14, the protective sheet feeding controller 218 actuates the first opening and closing mechanisms 208, so as to open the first chucks 64 and release the protective sheet 36. The above operating sequence of the first chucks 64 corresponds to the third mode of operation.

When the trailing end of the protective sheet 36 subsequently reaches the product roll 14, the adhesive tape 40 is applied to the protective sheet 36, which is wrapped around the product roll 14, directly beneath the product roll 14. The process of packaging the product roll 14 with the protective sheet 36 now is completed.

In step S26, the wrapping controller 124 stops the first drive roller 128*a* and the second drive roller 128*b* in order to hold the product roll 14 at rest in the wrapping unit 30. Thereafter, the wrapping controller 124 discharges the product roll 14, i.e., the wrapped product roll 14', which has been wrapped with the protective sheet 36 wrapped therearound. More specifically, the wrapping controller 124 actuates the V-shaped stage moving mechanism 158 to move the V-shaped stage 156 upwardly, and also actuates the second turning mechanism 136*b* of the first wrapping arm 122*a* and the third turning mechanism 136*c* of the second wrapping arm 122*b* to move the first wrapping arm 122*a* and the second wrapping arm 122*b* to respective spread positions, such that the first driven roller 134*a* and the second driven roller 134*b* are spaced from each other. The wing 156*a* of the V-shaped stage 156 is turned away from the wing 156*b* until an angle of 180°, for example, is formed between the wings 156*a*, 156*b*. When the V-shaped stage 156 lifts the wrapped product roll 14', the wrapped product roll 14' rolls off from the V-shaped stage 156 onto the discharge guide plate 144, whereupon the wrapped product roll 14' rolls toward the discharge conveyor 18. At this stage, all of the packaging units 12 complete the respective packaging processes thereof, and feed the wrapped product rolls 14' respectively onto the discharge conveyor 18. Further, at this time, in order to stabilize the attitude of each of the wrapped product rolls 14' as they are fed, for facilitating an image data inspection process to be described later, a known type of 90°-flipping mechanism, not shown, is actuated, so as to convert the attitude of the wrapped product roll 14' into a vertical position, such that one end face (reference end face) of the wrapped product roll 14' faces downwardly. Wrapped product rolls 14', the attitudes of which have been converted, are successively fed to a subsequent process by the discharge conveyor 18. While the wrapped product rolls 14' are fed by the discharge conveyor 18, the wrapped product rolls 14' are checked for the wrapped protective sheet 36 by an image data inspection process, for example. If a defective wrapped product roll 14', e.g., a wrapped product roll 14' with the protective sheet 36 thereof being wrapped poorly, leaving the rolled paper partially uncovered by the protective sheet 36, is detected during the image data inspection process, then the defective wrapped product roll 14' is automatically rejected from the discharge conveyor 18 by a defective product roll rejecter.

As described above, the product roll packaging apparatus 10 according to the present embodiment includes the position correcting mechanism 72 for correcting the position of the product roll 14. The position correcting mechanism 72 is capable of bringing an end face (reference end face) of the product roll 14, which is fed by the transfer unit 32, into alignment with the vertical plane including the reference line La. By using the EPC mechanism 52 to bring an edge (reference edge) of the protective sheet 36 into alignment with the vertical plane including the reference line La, the accuracy at which the product roll 14 is fed, the accuracy at which the protective sheet 36 is fed, and the accuracy at which the protective sheet 36 is positioned in a widthwise manner with respect to the product roll 14 can be increased, thereby making it possible to wrap the protective sheet 36 around the product roll 14 with a high level of quality in order to package the product roll 14.

More specifically, the EPC mechanism 52 controls the reference edge of the protective sheet 36 so as to be aligned with the reference line La established by the position correcting mechanism 72. Therefore, the protective sheet 36 is wrapped around the product roll 14 with the reference edge thereof being held in substantial alignment with an end face (reference end face) of the product roll 14. When the wrapped product roll 14' is fed to the discharge conveyor 18 and has the reference end face thereof held in contact with the surface of the discharge conveyor 18, the protective sheet 36 is free from edge folds and hence is prevented from becoming damaged due to edge folds. Also, the surface of the rolled paper of the wrapped product roll 14' is prevented from being exposed from the protective sheet 36. If the width of the protective sheet 36 is greater by about 1 mm than the width of the product roll 14, then the protective sheet 36 projects only about 1 mm from the end face of the wrapped product roll 14', which is remote from the reference end face thereof, and does not impair the appearance of the wrapped product roll 14'. According to the present embodiment, since the protective sheet 36 is fed while being positioned highly accurately in a widthwise manner, with an error of up to 0.2 mm, by the EPC mechanism 52, any distances by which the protective sheet 36 might possibly project in a widthwise directed from the product roll 14 are kept within a range of up to 0.2 mm.

The product roll 14 is corrected in position while being lifted by the transfer unit 32. Therefore, the product roll 14 is prevented from rubbing against and being damaged by the surface of the conveyor 20 while the product roll 14 is corrected in position.

While the first chucks 64 supply the protective sheet 36 to the wrapping unit 30, the first chucks 64 switch gripping positions on the protective sheet 36 between the first, second, and third modes of operation. It is thus possible to insert the leading end of the protective sheet 36 deeply into the gap between the extended portion **14*a* and the rolled paper of the product roll 14 near the proximal end of the extended portion 14*a*. Therefore, the inserted leading end of the protective sheet 36 is not displaced when the product roll 14** is rotated.

The total stroke by which the first chucks 64 feed the protective sheet 36 to the wrapping unit 30 in the first through third modes is at least twice the circumferential length of the product roll 14, i.e., at least 6.3 times the diameter of the product roll 14. This means that not only the leading end of the protective sheet 36 is gripped and fed by the first chucks 64 from a position near the cutters 62 to a position near the product roll 14, but also the trailing end of the protective sheet 36 is gripped and fed by the first chucks 64. Inasmuch as the protective sheet 36 is gripped and fed by the same first chucks 64 over the entire stroke thereof, the protective sheet 36 is accurately fed parallel to the reference line La.

In the illustrated embodiment, for the sake of brevity, steps S1 through S26 have been described as a chronological sequence of events or actions. However, some of steps S1 through S26 actually may be performed concurrently with each other. For example, the product roll 14 may be rotated in step S21 at the same time that the first chucks 64 are moved in step S20, thereby shortening the cycle time.

A process of changing sizes, i.e., widths, of product rolls 14 will be described below. For example, such a process of changing sizes is performed after product rolls 14, which have a width of 8 inches, have been wrapped in a previous cycle, and before product rolls 14, which have a width of 6 inches, are wrapped in a present cycle. More specifically, the position correcting mechanism 72 decides on one of the position sensors 116, which corresponds to the size of product rolls 14 to be wrapped in the present cycle, and establishes a reference line La, which corresponds to the size of the product rolls 14. The position correcting mechanism 72 then brings the product rolls 14 into alignment with the established reference line La. Since product rolls 14 having a width of 8 inches have been wrapped in the previous cycle, and product rolls 14 having a width of 6 inches are wrapped in the present cycle, the position correcting mechanism 72 should move the reference line La by only (8 inches−6 inches)/2. Stated otherwise, the reference line La is changed by an interval of one-half (½) the difference between sizes or widths of product rolls 14 in the previous and present cycles.

As the reference line La is moved depending on the change in the sizes of product rolls 14, the edge sensor 190 and the first chucks 64 also are moved by intervals of one-half (½) the difference between sizes or widths of product rolls 14 in the previous and present cycles. This is equivalent to moving the reference line La, which governs the reference end faces of the product rolls 14, by the distance that the edge sensor 190 and the first chucks 64 are moved.

Therefore, when product rolls 14 having a width of 6 inches are to be wrapped in a present cycle after product rolls 14 having a width of 8 inches have been wrapped in a previous cycle, the reference line La, the edge sensor 190, and the first chucks 64 are moved by intervals of one-half (½) the difference between sizes or widths of the product rolls 14 in the previous and present cycles, in preparation for packaging the product rolls 14 having a width of 6 inches with the protective sheet 36.

It is necessary to use a highly efficient automatic packaging apparatus for packaging mass-produced product rolls 14 with protective sheets 36. Heretofore, a single roll packaging apparatus has included a single packaging unit, and hence, multiple packaging apparatus are needed to achieve increased throughput. However, such packaging apparatus are costly and take up a large amount of factory space. In contrast, the product roll packaging apparatus 10 according to the present embodiment has a plurality of packaging units 12 and achieves a high throughput, although the product roll packaging apparatus 10 takes up a relatively small amount of factory space.

According to the present embodiment, as shown in FIG. 1, the leftmost packaging unit 12 (the first packaging unit 12*a*) is supplied with an 8-inch product roll 14, the rightmost packaging unit 12 (the sixth packaging unit 12*f*) is supplied with a 4-inch product roll 14, and the remaining four packaging units 12 (the second through fifth packaging units 12*b* through 12*e*) are supplied respectively with 6-inch product rolls 14. If 6-inch product rolls 14 are more versatile and are consumed in larger quantities, and the product rolls 14 of other sizes, i.e., the 10-, 8-, 5-, and 4-inch product rolls 14, are used in limited applications, then it is necessary to supply more 6-inch product rolls 14 than product rolls 14 of other sizes. In this case, since the leftmost and rightmost packaging units 12 are used to package product rolls 14 of other sizes, while the remaining four packaging units 12 are used to package the 6-inch product rolls 14, the product rolls 14 can be packaged efficiently without the need for frequent size changes. Since the leftmost and rightmost packaging units 12 are dedicated to packaging of product rolls 14 of other sizes, the wrapped product rolls 14' can subsequently be managed with ease, and can easily be sorted out and stored by size.

In the illustrated embodiment, the drive mechanism 120 includes the pair of first and second drive rollers 128*a*, 128*b*. However, the drive mechanism 120 may include a pair of mechanical chucks, comprising a reference-side chuck, which has an end face lying in the same plane as the reference line La, and an anti-reference-side chuck, which is movable to accommodate different core lengths of the product rolls 14.

Similarly, the protective sheet feeding mechanism 54 may be of a manually operable structure free of the reference-side sliding mechanism 210*a* and the anti-reference-side sliding mechanism 210*b*, which are actuatable to deal with different sizes of protective sheets 36. Although such a manually operable structure takes a longer time to change sizes of protective sheets 36, it makes the protective sheet feeding mechanism 54 smaller in size and less expensive to manufacture. The transfer unit 32, the protective sheet holding mechanism 56, and other mechanisms for dealing with different sizes of product rolls 14 and protective sheets 36 may also employ a manually operable structure.

Although a certain preferred embodiment of the present invention has been shown and described in detail, it should be understood that various changes and modifications may be made to the embodiment without departing from the scope of the invention as set forth in the appended claims.

What is claimed is:

1. A product roll packaging apparatus for packaging a product roll, which comprises a core and a roll of recording paper wound around the core, with a protective sheet wrapped around the product roll, and having an end attached onto the protective sheet with an adhesive tape, comprising:

a buffer conveyor assembly for keeping a product roll waiting to be wrapped;

a transfer unit for lifting and transferring the product roll from the buffer conveyor assembly;

a wrapping unit for wrapping a protective sheet around the product roll and attaching an end of the protective sheet with the adhesive tape;

a protective sheet supply unit for cutting off the protective sheet from a sheet roll and supplying the protective sheet along a protective sheet path line to the wrapping unit; and a tape supply unit for supplying the adhesive tape to the end of the protective sheet that has been cut by the protective sheet supply unit;

wherein the transfer unit includes a position correcting mechanism for establishing a reference line depending on a size of the product roll, and for bringing a reference end face of the product roll, which has been lifted by the transfer unit, into alignment with a vertical plane including the reference line; and the protective sheet supply unit includes an edge position control mechanism for bringing a reference edge of the protective sheet into alignment with the reference line established by the position correcting mechanism.

2. The product roll packaging apparatus according to claim 1, further comprising:

a pair of first chucks operable in at least a first mode for mechanically gripping opposite sides of a leading end of the protective sheet and feeding the protective sheet, and a second mode for mechanically gripping opposite sides of a portion of the protective sheet other than the leading end and feeding the protective sheet; and a pair of second chucks for mechanically gripping the leading end of the protective sheet in response to the first mode of operation of the first chucks, the second chucks being retractable from the protective sheet path line in response to the second mode of operation of the first chucks.

3. The product roll packaging apparatus according to claim 2, wherein the first chucks switch gripping positions on the protective sheet between the first mode and the second mode before supplying the protective sheet to the wrapping unit.

4. The product roll packaging apparatus according to claim 3, wherein a total stroke by which the first chucks supply the protective sheet gripped thereby to the wrapping unit in the first mode and the second mode is at least 6.3 times a diameter of the product roll.

5. The product roll packaging apparatus according to claim 2, further comprising:

a protective sheet supply roller for unreeling the protective sheet a predetermined length from the sheet roll;

wherein the first chucks are normally biased along the protective sheet path line toward the wrapping unit; and the first chucks are movable over a stroke, which is longer than the stroke over which the protective sheet supply roller unreels the protective sheet from the sheet roll.

6. The product roll packaging apparatus according to claim 1, further comprising:

a pair of first chucks operable in at least a first mode for mechanically gripping opposite sides of a leading end of the protective sheet and feeding the protective sheet, a second mode for mechanically gripping opposite sides of a portion of the protective sheet other than the leading end and feeding the protective sheet, and a third mode for mechanically gripping opposite sides of a trailing end of the protective sheet other than the leading end and feeding the protective sheet; and a pair of second chucks for mechanically gripping the leading end of the protective sheet in response to the first mode of operation of the first chucks, the second chucks being retractable from the protective sheet path line in response to the second mode of operation of the first chucks.

7. The product roll packaging apparatus according to claim 6, wherein the first chucks switch gripping positions on the protective sheet between the first mode and the second mode before supplying the protective sheet to the wrapping unit.

8. The product roll packaging apparatus according to claim 7, wherein a total stroke by which the first chucks supply the protective sheet gripped thereby to the wrapping unit in the first mode, the second mode, and the third mode is at least 6.3 times a diameter of the product roll.

9. The product roll packaging apparatus according to claim 6, further comprising:

a protective sheet supply roller for unreeling the protective sheet a predetermined length from the sheet roll;

wherein the first chucks are normally biased along the protective sheet path line; and the first chucks are movable over a stroke, which is longer than the stroke over which the protective sheet supply roller unreels the protective sheet from the sheet roll.

10. The product roll packaging apparatus according to claim 1, wherein the wrapping unit comprises:

a drive mechanism for rotating and stopping the product roll; and a pair of wrapping arms for gripping opposite sides of the product roll while keeping the product roll rotatable;

wherein the drive mechanism includes a pair of drive rollers for contacting a lower portion of the product roll and rotating the product roll, and the drive mechanism stops the product roll against rotation when at least an extended portion of the product roll is directed toward the protective sheet path line.

11. The product roll packaging apparatus according to claim 1, wherein the wrapping unit comprises:

a drive mechanism for rotating and stopping the product roll; and a pair of wrapping arms for gripping opposite sides of the product roll while keeping the product roll rotatable;

wherein the drive mechanism includes a pair of mechanical chucks comprising a reference-side mechanical chuck and an anti-reference-side mechanical chuck, the reference-side mechanical chuck having an end face lying in the vertical plane including the reference line, the anti-reference-side mechanical chuck being movable to accommodate different lengths of the cores of product rolls, and wherein the drive mechanism stops the product roll against rotation when at least an extended portion of the product roll is directed toward the protective sheet path line.

12. The product roll packaging apparatus according to claim 1, wherein when the product roll is changed in size, at least the reference line established by the position correcting mechanism and the reference edge of the protective sheet are changed in position by intervals of ½ of a difference between the size of a product roll wrapped in a previous cycle and the size of a product roll to be wrapped in a present cycle.

13. The product roll packaging apparatus according to claim 1, wherein the product roll and the protective sheet are substantially equal to each other in width.

14. A product roll packaging apparatus for packaging a product roll, which comprises a core and a roll of recording paper wound around the core, with a protective sheet wrapped around the product roll, and having an end attached onto the protective sheet with an adhesive tape, comprising:

a buffer conveyor assembly for keeping a plurality of product rolls waiting to be wrapped;

a plurality of packaging units, arrayed along a direction in which the buffer conveyor assembly feeds the product rolls, for packaging the product rolls with respective protective sheets wrapped therearound; and a discharge conveyor, disposed in confronting relation to the buffer conveyor assembly with the packaging units interposed therebetween, for discharging wrapped product rolls along the direction in which the buffer conveyor assembly feeds the product rolls;

wherein each of the packaging units comprises:

a transfer unit for lifting and transferring one of the product rolls from the buffer conveyor assembly;

a wrapping unit for wrapping a protective sheet around the product roll and attaching an end onto the protective sheet with the adhesive tape;

a protective sheet supply unit for cutting off the protective sheet from a sheet roll and supplying the protective sheet along a protective sheet path line to the wrapping unit; and a tape supply unit for supplying the adhesive tape to the end of the protective sheet that has been cut by the protective sheet supply unit;

wherein the transfer unit includes a position correcting mechanism for establishing a reference line depending on a size of the product roll, and for bringing a reference end face of the product roll, which has been lifted by the transfer unit, into alignment with a vertical plane including the reference line; and the protective sheet supply unit includes an edge position control mechanism for bringing a reference edge of the protective sheet into alignment with the reference line established by the position correcting mechanism.

15. A product roll packaging method of packaging a product roll, which comprises a core and a roll of recording paper wound around the core, with a protective sheet wrapped around the product roll, and having an end attached onto the protective sheet with an adhesive tape, comprising the steps of:

keeping a product roll waiting to be wrapped;

lifting and transferring the product roll to a wrapping unit, wrapping a protective sheet around the product roll, and attaching an end onto the protective sheet with the adhesive tape;

cutting off the protective sheet from a sheet roll and supplying the protective sheet along a protective sheet path line to the wrapping unit; and supplying the adhesive tape to the end of the protective sheet;

wherein the step of transferring the product roll to the wrapping unit further comprises the steps of establishing a reference line depending on a size of the product roll, and bringing a reference end face of the product roll, which has been lifted, into alignment with a vertical plane including the reference line; and the step of supplying the adhesive tape further comprises the step of bringing a reference edge of the protective sheet into alignment with the reference line.

* * * * *